US006806100B1

(12) United States Patent
Xu et al.

(10) Patent No.: US 6,806,100 B1
(45) **Date of Patent: *Oct. 19, 2004**

(54) MOLDED END POINT DETECTION WINDOW FOR CHEMICAL MECHANICAL PLANARIZATION

(75) Inventors: Cangshan Xu, Fremont, CA (US); Patrick P. H. Wu, Milpitas, CA (US); Xuyen Pham, Fremont, CA (US)

(73) Assignee: Lam Research Corporation, Fremont, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/330,519

(22) Filed: Dec. 24, 2002

(51) Int. Cl.[7] ..... H01L 21/00
(52) U.S. Cl. ..... 438/8; 451/6
(58) Field of Search ..... 438/8, 16, 692; 451/6

(56) References Cited

U.S. PATENT DOCUMENTS 6,599,765 B1 * 7/2003 Boyd et al. ..... 438/16
6,641,470 B1 * 11/2003 Zhao et al. ..... 451/523
2003/0084774 A1 * 5/2003 David ..... 83/876

* cited by examiner

*Primary Examiner*—David Nelms
*Assistant Examiner*—Quoc Hoang
(74) *Attorney, Agent, or Firm*—Martine & Penilla, LLP

(57) ABSTRACT

An optical window structure for use in chemical mechanical planarization is provided. The optical window structure includes a polishing pad and an optical window opening in the polishing pad. The optical window structure also includes a molded optical window attached to an underside of the polishing pad, a molded portion of the optical window at least partially protruding into the optical window opening in the polishing pad.

32 Claims, 19 Drawing Sheets

MOLDED END POINT DETECTION WINDOW FOR CHEMICAL MECHANICAL PLANARIZATION

BACKGROUND OF THE INVENTION

1. Field of the Invention

This invention relates generally to endpoint detection in a chemical mechanical planarization process, and more particularly to endpoint detection using a preformed detection window.

2. Description of the Related Art

In the fabrication of semiconductor devices, there is a need to perform chemical mechanical planarization (CMP) operations. Typically, integrated circuit devices are in the form of multi-level structures. At the substrate level, transistor devices having diffusion regions are formed. In subsequent levels, interconnect metallization lines are patterned and electrically connected to the transistor devices to define the desired functional device. As is well known, patterned conductive layers are insulated from other conductive layers by dielectric materials, such as silicon dioxide. As more metallization levels and associated dielectric layers are formed, the need to planarize the dielectric material grows. Without planarization, fabrication of further metallization layers becomes substantially more difficult due to the variations in the surface topography. In other applications, metallization line patterns are formed in the dielectric material, and then, metal CMP operations are performed to remove excess metallization.

A chemical mechanical planarization (CMP) system is typically utilized to polish a wafer as described above. A CMP system typically includes system components for handling and polishing the surface of a wafer. Such components can be, for example, an orbital polishing pad, or a linear belt polishing pad. The pad itself is typically made of a polyurethane material. In operation, the belt pad is put in motion and then a slurry material is applied and spread over the surface of the belt pad. Once the belt pad having slurry on it is moving at a desired rate, the wafer is lowered onto the surface of the belt pad. In this manner, wafer surface that is desired to be planarized is substantially smoothed, much like sandpaper may be used to sand wood. The wafer may then be cleaned in a wafer cleaning system.

In the prior art, CMP systems typically implement belt, orbital, or brush stations in which belts, pads, or brushes are used to scrub, buff, and polish one or both sides of a wafer. Slurry is used to facilitate and enhance the CMP operation. Slurry is most usually introduced onto a moving preparation surface, e.g., belt, pad, brush, and the like, and distributed over the preparation surface as well as the surface of the semiconductor wafer being buffed, polished, or otherwise prepared by the CMP process. The distribution is generally accomplished by a combination of the movement of the preparation surface, the movement of the semiconductor wafer and the friction created between the semiconductor wafer and the preparation surface.

FIG. 1A shows a cross sectional view of a dielectric layer 2 undergoing a fabrication process that is common in constructing damascene and dual damascene interconnect metallization lines. The dielectric layer 2 has a diffusion barrier layer 4 deposited over the etch-patterned surface of the dielectric layer 2. The diffusion barrier layer, as is well known, is typically titanium nitride (TiN), tantalum (Ta), tantalum nitride (TaN) or a combination of tantalum nitride (TaN) and tantalum (Ta). Once the diffusion barrier layer 4 has been deposited to the desired thickness, a copper layer 6 is formed over the diffusion barrier layer in a way that fills the etched features in the dielectric layer 2. Some excessive diffusion barrier and metallization material is also inevitably deposited over the field areas. In order to remove these overburden materials and to define the desired interconnect metallization lines and associated vias (not shown), a chemical mechanical planarization (CMP) operation is performed.

As mentioned above, the CMP operation is designed to remove the top metallization material from over the dielectric layer 2. For instance, as shown in FIG. 1B, the overburden portion of the copper layer 6 and the diffusion barrier layer 4 have been removed. As is common in CMP operations, the CMP operation must continue until all of the overburden metallization and diffusion barrier material 4 is removed from over the dielectric layer 2. However, in order to ensure that all the diffusion barrier layer 4 is removed from over the dielectric layer 2, there needs to be a way of monitoring the process state and the state of the wafer surface during its CMP processing. This is commonly referred to as endpoint detection. Endpoint detection for copper is performed because copper cannot be successfully polished using a timed method. A timed polish does not work with copper because the removal rate from a CMP process is not stable enough for a timed polish of a copper layer. The removal rate for copper from a CMP process varies greatly. Hence, monitoring is needed to determine when the endpoint has been reached. In multi-step CMP operations there is a need to ascertain multiple endpoints: (1) to ensure that Cu is removed from over the diffusion barrier layer; (2) to ensure that the diffusion barrier layer is removed from over the dielectric layer. Thus, endpoint detection techniques are used to ensure that all of the desired overburden material is removed.

Many approaches have been proposed for the endpoint detection in CMP of metal. The prior art methods generally can be classified as direct and indirect detection of the physical state of polish. Direct methods use an explicit external signal source or chemical agent to probe the wafer state during the polish. The indirect methods on the other hand monitor the signal internally generated within the tool due to physical or chemical changes that occur naturally during the polishing process.

Indirect endpoint detection methods include monitoring: the temperature of the polishing pad/wafer surface, vibration of polishing tool, frictional forces between the pad and the polishing head, electrochemical potential of the slurry, and acoustic emission. Temperature methods exploit the exothermic process reaction as the polishing slurry reacts selectively with the metal film being polished. Friction-based methods in which motor current changes are monitored as different metal layers are polished can also typically be utilized.

Another endpoint detection method demodulates the acoustic emission resulting from the grinding process to yield information on the polishing process. Acoustic emission monitoring is generally used to detect the metal endpoint. The method monitors the grinding action that takes place during polishing. A microphone is positioned at a predetermined distance from the wafer to sense acoustical waves generated when the depth of material removal reaches a certain determinable distance from the interface to thereby generate output detection signals. All these methods provide a global measure of the polish state and have a strong dependence on process parameter settings and the selection of consumables. However, none of the methods except for the friction sensing have achieved some commercial success in the industry.

Direct endpoint detection methods monitor the wafer surface using acoustic wave velocity, optical reflectance and interference, impedance/conductance, electrochemical potential change due to the introduction of specific chemical agents. An approach to monitor the acoustic wave velocity propagated through the wafer/slurry to detect the metal endpoint is sometimes utilized. When there is a transition from one metal layer into another, the acoustic wave velocity changes and this has been used for the detection of endpoint. A method of endpoint detection using a sensor to monitor fluid pressure from a fluid bearing located under the polishing pad is also used at times. The sensor is used to detect a change in the fluid pressure during polishing, which corresponds to a change in the shear force when polishing transitions from one material layer to the next. Unfortunately, this method is not robust to process changes. Further, the endpoint detected is global, and thus the method cannot detect a local endpoint at a specific point on the wafer surface. Moreover, the method often utilized is restricted to a linear polisher, which requires an air bearing.

There have been many proposals to detect the endpoint using the optical reflectance from the wafer surface. They can be grouped into two categories: monitoring the reflected optical signal at a single wavelength using a laser source (such as, for example, 600 nm) or using a broad band light (such as, for example, 255 nm to 700 nm) source covering the full visible range of the electromagnetic spectrum. Another endpoint detection method that is sometimes utilized is the using of a single wavelength in which an optical signal from a laser source is impinged on the wafer surface and the reflected signal is monitored for endpoint detection. The change in the reflectivity as the polish transfers from one metal to another is used to detect the transition. Unfortunately, the single wavelength endpoint detection has a problem of being overly sensitive to the absolute intensity of the reflected light, which has a strong dependence on process parameter settings and the selection of consumables. In dielectric CMP applications, such single wavelength endpoint detection techniques also have a disadvantage that it can only measure the difference between the thickness of a wafer but typically cannot measure the actual thickness of the wafer.

Broad band methods rely on using information in multiple wavelengths of the electromagnetic spectrum. Such methods typically use a spectrometer to acquire an intensity spectrum of reflected light in the visible range of the optical spectrum. In metal CMP applications, the whole spectrum is used to calculate the end point detection (EPD signal). Significant shifts in the detection signal indicate the transition from one metal to another.

A common problem with current endpoint detection techniques is that some degree of over-etching is required to ensure that all of the conductive material (e.g., metallization material or diffusion barrier layer 4) is removed from over the dielectric layer 2 to prevent inadvertent electrical interconnection between metallization lines. A side effect of improper endpoint detection or over-polishing is that dishing 8 occurs over the metallization layer that is desired to remain within the dielectric layer 2. The dishing effect essentially removes more metallization material than desired and leaves a dish-like feature over the metallization lines. Dishing is known to impact the performance of the interconnect metallization lines in a negative way, and too much dishing can cause a desired integrated circuit to fail for its intended purpose. In view of the foregoing, there is a need for endpoint detection systems and methods that improve accuracy in endpoint detection.

FIG. 1C shows a prior art belt CMP system 10 in which a pad 12 is designed to rotate around rollers 16. As is common in belt CMP systems, a platen 14 is positioned under the pad 12 to provide a surface onto which a wafer will be applied using a carrier 18 (as shown in FIG. 1D). The pad 12 also contains a pad slot 12*a* so end point detection may be conducted as described in FIG. 1D.

FIG. 1D shows a typical way of performing end-point detection using a rotary CMP system an optical detector 20 in which light is applied through the platen 14, through the pad 12 and onto the surface of the wafer 24 being polished. In order to accomplish optical end-point detection, a pad slot 12*a* is formed into the pad 12. In some embodiments, the pad 12 may include a number of pad slots 12*a* strategically placed in different locations of the pad 12. Typically, the pad slot 12*a* is designed small enough to minimize the impact on the polishing operation. In addition to the pad slot 12*a*, a platen slot 22 is defined in the platen 14. The platen slot 22 is designed to allow the optical beam to be passed through the platen 14, through the pad 12, and onto the desired surface of the wafer 24 during polishing.

By using the optical detector 20, it is possible to ascertain a level of removal of certain films from the wafer surface. This detection technique is designed to measure the thickness of the film by inspecting the interference patterns received by the optical detector 20. Additionally, conventional platens 14 are designed to strategically apply certain degrees of back pressure to the pad 12 to enable precision removal of the layers from the wafer 24.

In typical end point detection systems such as shown in FIG. 1C, an optical opening is cut into a polishing belt. As shown in FIG. 1B, an optical opening is generally utilized within a polishing pad and a platen so a laser or light may be shined onto the wafer and a reflection may be received to determine the amount polished from the wafer.

FIG. 1E shows a dual graph 40 of end point detection data obtained from utilizing a broad spectrum of light end point detection that illustrates polishing distance detection. In an upper graph 41 showing the reflected light intensity, a curve 42 shows the intensity level of reflection for different frequencies of a light utilized for end point detection. The upper graph 41 has a vertical axis that indicates intensity and a horizontal axis showing frequency. The curve 42 with the upper graph 41 shows the differing intensity of light reflection from a wafer depending on the different frequencies of optical signals transmitted to the wafer. The intensities of light reflection as shown by the curve 42 is the optimal optical signal transmission through an optical window without any slurry on top of it. Unfortunately, when the light is blocked by slurry as occurs in prior art flat optical window systems, intensity of the light transmitted to the wafer and received back from the wafer by an optical detection unit is decreased (signal/noise decreases) as shown by a curve 44 which is a typical prior art profile curve. Therefore the curve 42 is not achieved by prior art systems when slurry accumulates in the polishing window.

Once a fourier transform 50 is conducted, a peak 46 and a curve 48 are shown in a lower graph 43 showing end point detection (EPD) intensity. The lower graph 43 has a vertical axis of intensity and a horizontal axis of thickness. The peak 46 of the lower graph 43 is produced by way of the fourier transform 50 of the curve 42, and the curve 48 is produced on the lower graph 43 by the fourier transform 50 of the curve 44. If an optical signal received by the optical detection is weak, as shown by curve 44, then the curve 48 is fuzzy and not as sharp as the peak 46 which results from reception of a strong optical signal by the light detection unit. Consequently, the curve 48 does not show as precise a film thickness polished as peak 46. Therefore, the stronger the optical signal received, the clearer measurement of film thickness that is made by the optical detection unit. Therefore, it is highly advantageous for a strong optical signal to be able to pass to the wafer or reflect from the wafer through an optical window to reach the optical detection unit.

FIG. 1F illustrates a prior art flat optical window system 60 for use during end point detection in a CMP process. In this example, a polishing pad 62 moves over platen 64 which in this example is a metallic table which may lend support to the polishing pad during the polishing action. A flat optical window 66 is attached to the polishing pad 62, and during polishing moves over a platen opening 70 which is generally a hole exposing the flat optical window 66 to an optical detector 72. Generally, flat optical windows of the prior art have a thickness of between 15 and 30 mils (a mil equals $1\times10^{-3}$ inch). As slurry 68 is deposited on top of the polishing pad 62, the slurry 68 accumulates in a polishing pad hole above the flat optical window 66. Unfortunately, the accumulation of slurry reduces reflection back of the optical signal to the optical detector 72, especially for shorter wavelength signals.

Unfortunately the prior art method and apparatus of end point detections in CMP operations as described in reference to FIGS. 1A, 1B, 1C, 1D, 1E, and 1F have various problems. The prior art apparatus also has problems with oxide removal where too much or too little may be removed due to inaccurate readings in optical endpoint detection resulting from accumulation of slurry in the flat optical window. Specifically, the accumulation of slurry often decreases the intensity of optical signal received by the optical detection unit from the wafer as shown in FIG. 1E. Because the prior art optical windows are configured to be flat in a polishing pad opening, slurry dispensed during CMP pools in the polishing pad hole. As more and more slurry flows into the polishing pad hole, more optical signal interference is created. This may significantly reduce wafer polishing accuracy and resultant wafer production reliability. Such a decrease in wafer polishing accuracy may serve to significantly increase wafer production costs. Consequently, these problems arise due to the fact that the prior art polishing belt designs do not properly control and reduce slurry accumulation on top of the optical window.

Therefore, there is a need for a method and an apparatus that overcomes the problems of the prior art by having a polishing pad structure that reduces slurry accumulation over an optical window that further enables more consistent and effective end point detection for more accurate polishing in a CMP process.

SUMMARY OF THE INVENTION

Broadly speaking, the present invention fills these needs by providing a molded optical window for use with polishing pads for polishing a wafer during a chemical mechanical planarization (CMP) process. The apparatus includes a CMP pad with molded optical windows that resist accumulation of light blocking substances and therefore increase reception of light by an optical detection unit for end point detection. It should be appreciated that the present invention can be implemented in numerous ways, including as a process, an apparatus, a system, a device or a method. Several inventive embodiments of the present invention are described below.

In one embodiment, an optical window structure for use in chemical mechanical planarization is provided. The optical window structure includes a polishing pad and an optical window opening in the polishing pad. The optical window structure also includes a molded optical window attached to an underside of the polishing pad, a molded portion of the optical window at least partially protruding into the optical window opening in the polishing pad.

In another embodiment, a method to generate an optical window structure is provided The method includes providing a polishing pad, and generating an optical window opening in the polishing pad. The method also includes molding an optical window, and attaching the molded optical window to an underside of the polishing pad so that a molded portion of the optical window at least partially protrudes into the optical window opening.

In yet another embodiment, an optical window structure for use in chemical mechanical planarization is provided. The optical window structure includes a multi-layer polishing pad, and an optical window opening in the multi-layer polishing pad. The optical window structure also includes an optical window having a molded portion where the optical window is attached to an underside of the multi-layer polishing pad, and the molded portion of the optical window at least partially protrudes into the optical window opening.

In another embodiment, a method to generate an optical window structure is provided. The method includes providing a multi-layer polishing pad, and generating an optical window opening in the multi-layer polishing pad. The method also includes molding an optical window, and attaching the molded optical window the multi-layer polishing pad so that a molded portion of the optical window at least partially protrudes into the optical window opening.

The advantages of the present invention are numerous. Most notably, by constructing and utilizing a molded optical window structure in accordance the present invention, the polishing pad will be able to provide more efficient and effective planarization/polishing operations over wafer surfaces (e.g., metal and oxide surfaces). Furthermore, wafers placed through a CMP operation using the molded optical window structure are polished with better accuracy and more consistency. In addition, the increased wafer polishing efficiency leads to greater wafer production. The molded optical window keeps slurry from accumulating on top of an area where optical signal may travel. Therefore, an optical detection unit utilized during end point detection may transmit and receive optimal optical signals through the molded optical window to accurately determine the amount of polishing that has been completed in a CMP process. Moreover, the molded optical window may be generated in a more efficient and time consuming manner than other typical types of optical windows. The molded optical window may also enhance planarizations that require exacting end point detection such a dielectric shallow trench isolation.

Other aspects and advantages of the present invention will become apparent from the following detailed description, taken in conjunction with the accompanying drawings, illustrating by way of example the principles of the present invention.

BRIEF DESCRIPTION OF THE DRAWINGS

The present invention will be readily understood by the following detailed description in conjunction with the accompanying drawings. To facilitate this description, like reference numerals designate like structural elements.

DETAILED DESCRIPTION OF THE PREFERRED EMBODIMENTS

Figure 1A:
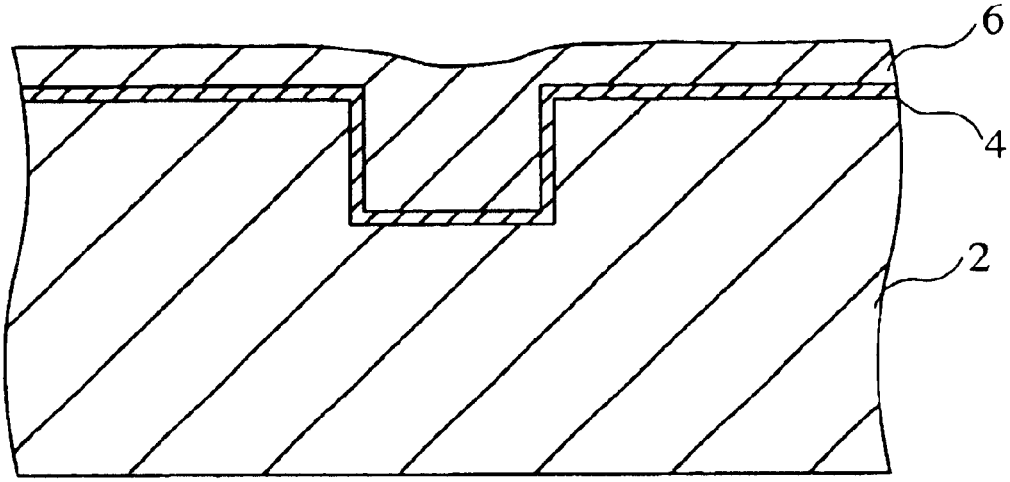
FIG. 1A (Prior Art)
FIG. 1A shows a cross sectional view of a dielectric layer undergoing a fabrication process that is common in constructing damascene and dual damascene interconnect metallization lines.
Figure 1B:
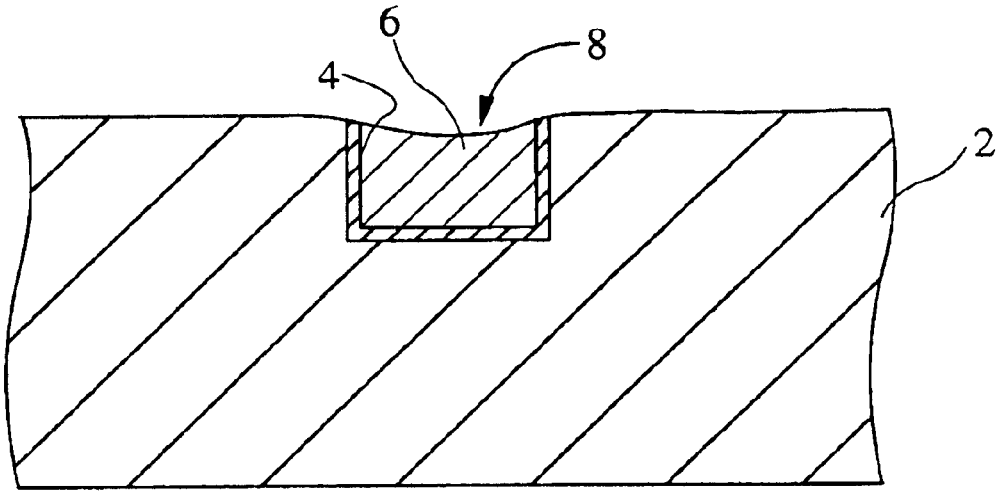
FIG. 1B (Prior Art)
FIG. 1B shows a cross sectional view of a dielectric layer after an overburden portion of the copper layer and a diffusion barrier layer have been removed
Figure 1C:
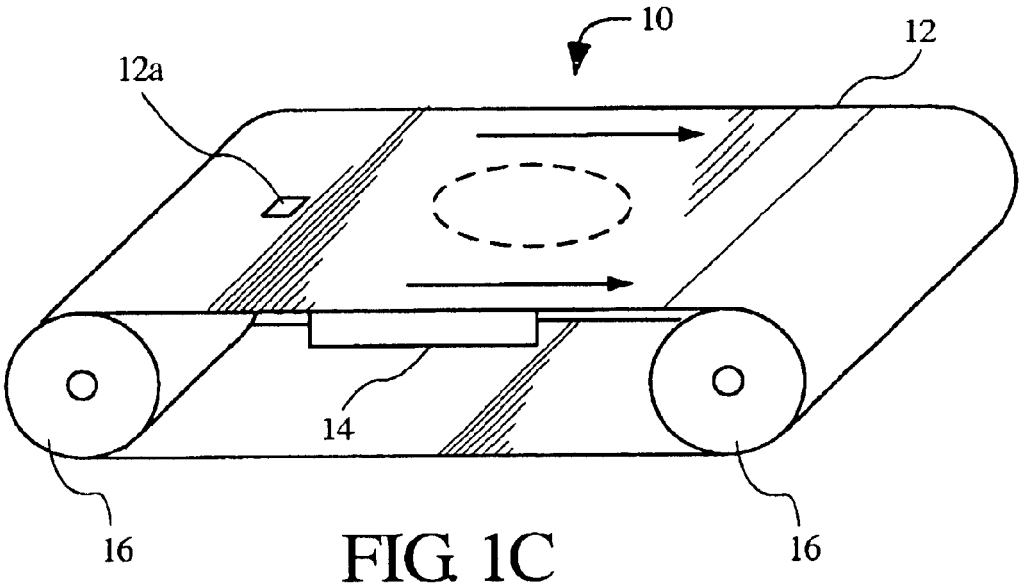
FIG. 1C (Prior Art)
FIG. 1C shows a prior art belt CMP system in which a pad is designed to rotate around rollers.
Figure 1D:
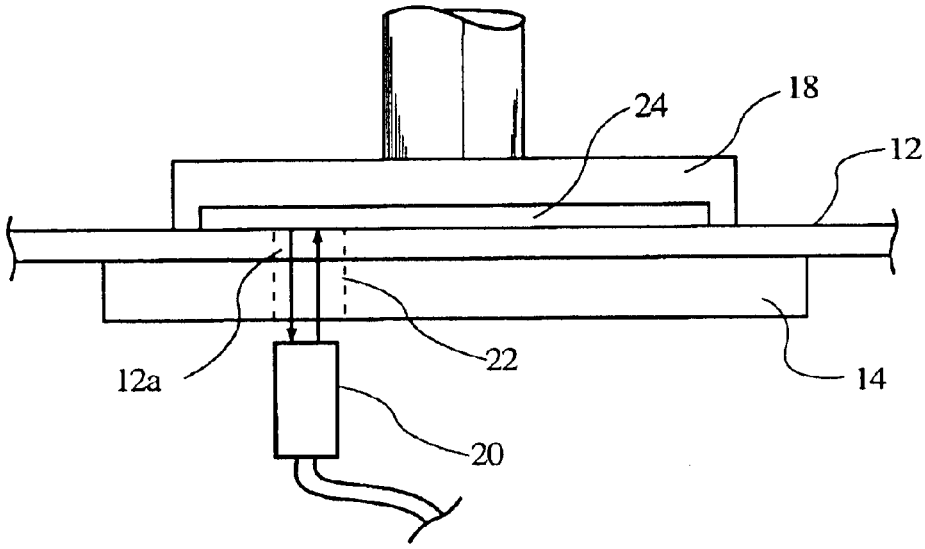
FIG. 1D (Prior Art)
FIG. 1D shows a typical way of performing end-point detection using a rotary CMP system an optical detector in which light is applied through the platen, through the pad and onto the surface of the wafer being polished.
Figure 1E:
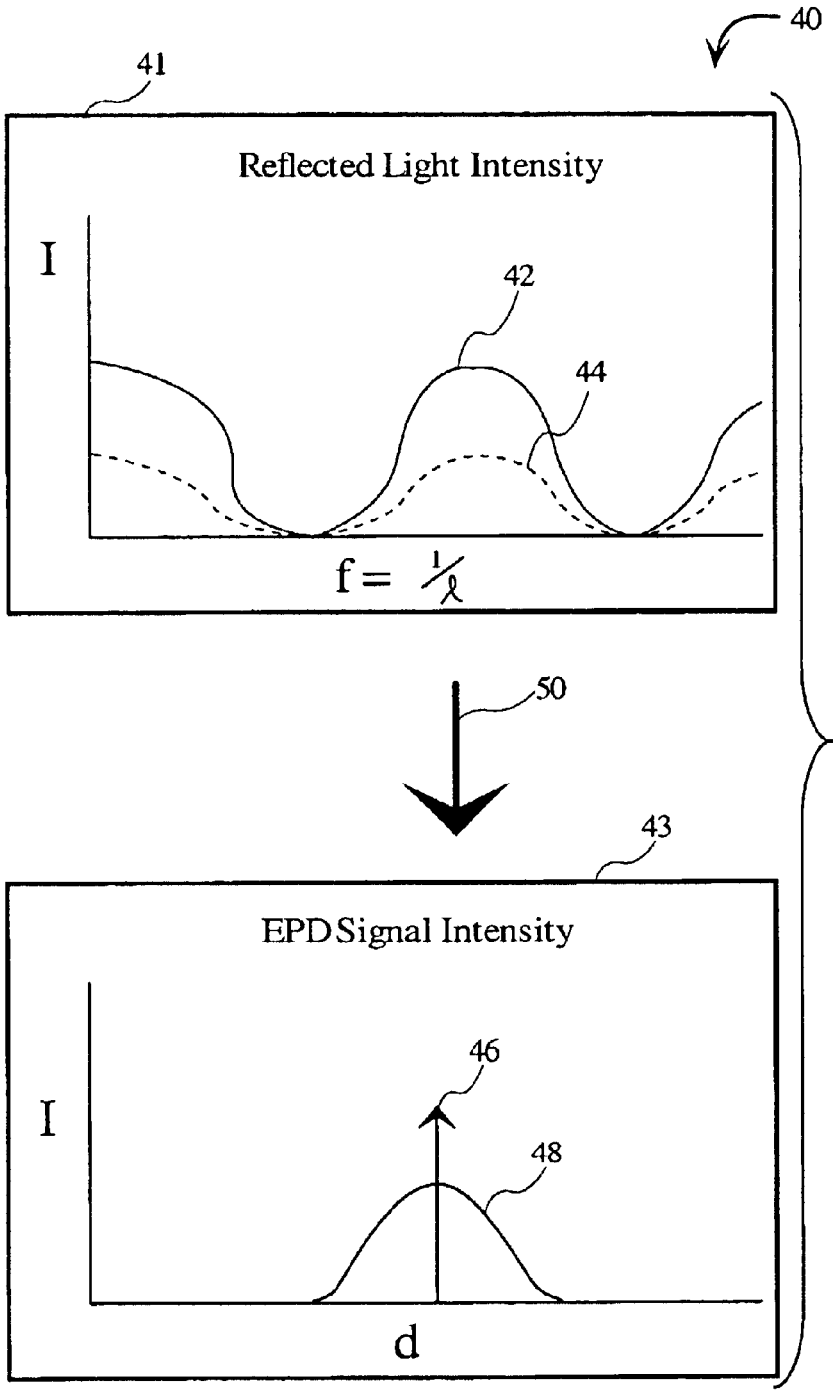
FIG. 1E (Prior Art)
FIG. 1E shows a dual graph of end point detection data obtained from utilizing a broad spectrum of light end point detection that illustrates polishing distance detection.
Figure 1F:
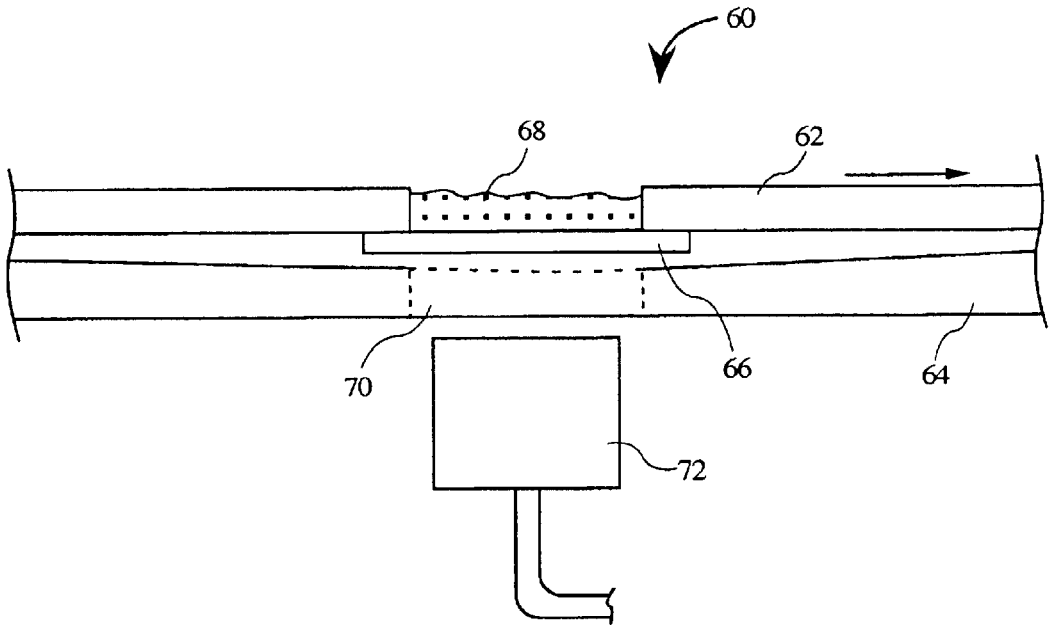
FIG. 1F (Prior Art)
FIG. 1F illustrates a prior art flat optical window system for use during end point detection in a CMP process.

An invention is disclosed for a molded optical windows used in CMP where the molded optical windows are more resistant to slurry accumulation and therefore increase reception of light intensity by an optical detection unit due to less slurry in an optical window hole. In the following description, numerous specific details are set forth in order to provide a thorough understanding of the present invention. It will be understood, however, by one of ordinary skill in the art, that the present invention may be practiced without some or all of these specific details. In other instances, well known process operations have not been described in detail in order not to unnecessarily obscure the present invention.

In general terms, the present invention is directed toward a molded optical window and a molded optical window structure. The molded optical window structure includes a polishing pad with a support layer and a molded optical window. The molded optical window may be configured to reduce slurry accumulation on top of it. In this way, the molded optical window may reduce the amount of optical transmission blocked by the slurry introduced during CMP. Consequently, the intensity of optical reflection received from the wafer surface through the molded optical window of the present invention may be stronger than if a prior art flat optical window is utilized thereby optimizing determination of the amount of polishing that has been completed in a CMP process. In this way, optical signals of optimal intensity may be transmitted and received by an optical detection unit located below the molded optical window structure and a platen to determine the amount of polishing that has been completed in a CMP process. Moreover, the molded optical window may be produced in a more efficient and cost effective manner than other typical optical windows.

In a preferable embodiment, a polishing pad of the molded optical window structure is preferably adhered to a support layer (which may include a cushioning layer and a reinforcement layer such as, for example a stainless steel layer or a Kevlar-type material, connected by an adhesive). A molded optical window may be attached to the polishing pad or the support layer in any way which enables the optical window to reduce the amount of slurry that may accumulate on a surface of the molded optical window such as, for example, by using adhesives.

The molded optical window structure may include a polishing pad in addition to any other structural component that may be utilized in conjunction with the polishing pad such as, for example, the cushioning layer, the support layer, a reinforcement layer, any molded optical window, etc. In a preferable embodiment, the reinforcement layer is a stainless steel belt or a Kevlar type material belt. The polishing pad within the molded optical window structure may be in either a generic pad form, a belt form, or any other form that may be utilized in a CMP process such as, for example, a seamless polymeric polishing pad, a seamless polymeric polishing belt, polymeric polishing pad, a linear belt polymeric polishing pad, polymeric polishing belt, a polishing layer, a polishing belt, etc. The polishing pad may be of a multi-layer variety that preferably includes a stainless steel or a Kevlar type material reinforcement layer. Furthermore, the molded optical window structure of the present invention may be utilized in any type of operation which may require controlled, efficient, and accurate polishing of any surface of any type of material.

Figure 2A:
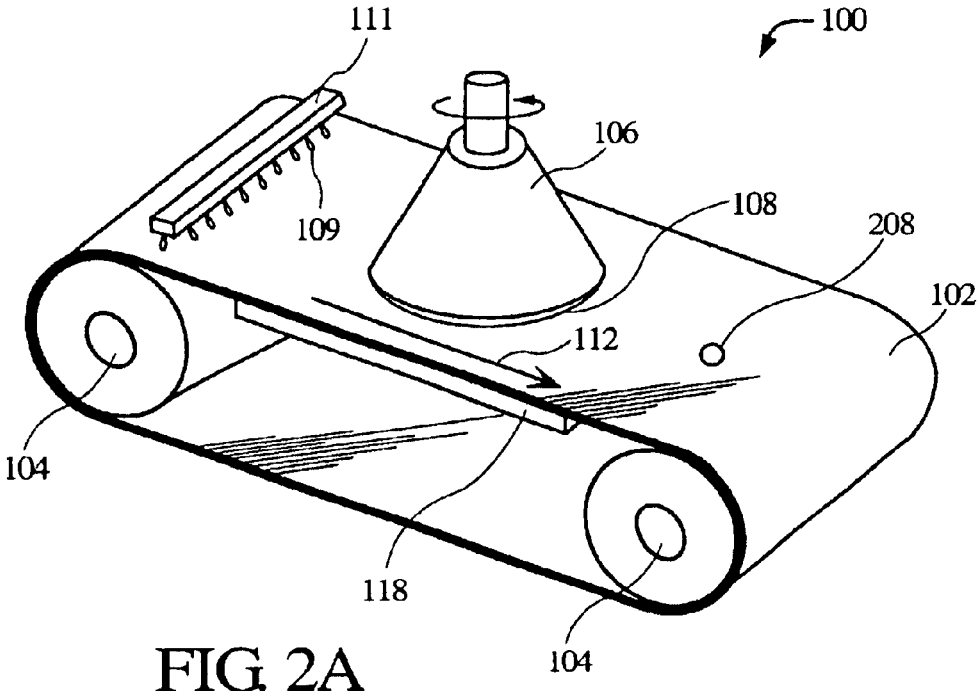
FIG. 2A shows a top view of a CMP system according to one embodiment of the present invention.

FIG. 2A shows a top view of a CMP system 100 according to one embodiment of the present invention. A polishing head 106 may be used to secure and hold a wafer 108 in place during processing. A polishing pad 102 preferably forms a continuous loop around rotating drums 104. It should be understood that the polishing pad 102 may include a polishing layer with a support layer which may include a cushioning layer and a reinforcement layer. The polishing layer may be secured to the support layer by using a any type of glue or other adhesive material such as, for example a 3M 467 adhesive. In another embodiment, the polishing layer may be secured to support layer through a direct casting of polyurethane on top of the support layer. The polishing pad 102 preferably includes a molded optical window 208 of the present invention through which end point detection may be conducted.

The polishing pad 102 may rotate in a direction 112 indicated by the arrow. It should be understood that the polishing pad 102 may move at any speed to optimize the planarization process. In one embodiment, the polishing pad 102 may move at a speed of about 400 feet per minute. As the belt rotates, a polishing slurry 109 may be applied and spread over the surface of the polishing pad 102 by a slurry dispenser 111. The polishing head 106 may then be used to lower the wafer 108 onto the surface of the polishing pad 102. In this manner, the surface of the wafer 102 that is desired to be planarized is substantially smoothed.

In some cases, the CMP operation is used to planarize materials such as copper (or other metals), and in other cases, it may be used to remove layers of dielectric or combinations of dielectric and copper. Although the molded optical window described herein is shown in exemplary embodiments as being used in CMP applications, it should be appreciated that the molded optical window may be utilized in any suitable type of substrate processing application such as, for example applications involving, shallow trench isolation planarization, inter-level dielectric (ILD)/inter-metal dielectric (IMD) planarization, tungsten planarization, and poly-silicon planarization, etc. In one embodiment, the CMP operation utilizing the molded optical window 208 may be used to perform exacting planarization operations that require very accurate end point detection such as dielectric shallow trench isolation. The rate of planarization may be changed by adjusting the polishing pressure applied to the polishing pad 102. The polishing rate is generally proportional to the amount of polishing pressure applied to the polishing pad 102 against a platen 118. In one embodiment, the platen 118 may use an air bearing which is generally a pressurized air cushion between the platen 118 and the polishing pad 102. It should be understood that the platen 118 may utilize any other type of bearing such as, for example, fluid bearing, etc. After the desired amount of material is removed from the surface of the wafer 101, the polishing head 106 may be used to raise the wafer 108 off of the polishing pad 102. The wafer is then ready to proceed to a wafer cleaning system.

In such an embodiment, the molded optical window 208 may be configured to keep slurry from accumulating on the molded optical window 208 so end point detection may be conducted in a more accurate manner thus resulting in better wafer polishing controllability. The molded optical window 208 of the present invention may also be configured for slurry removal during the CMP process by the pressurized air from the platen 118 by molding.

It should be appreciated that although the molded optical window 208 is shown in these exemplary embodiments as being used with a belt-type CMP system, it should be appreciated that the molded optical window 208 may be used in a rotary-type CMP system and an orbital-type CMP system. In generic terms, as known by those skilled in the art, a rotary-type CMP system has a polishing head and rotating platen with polishing pads mounted on the platen where the wafer is mounted on the head comes down to the rotating platen during polishing. In such an embodiment, the molded optical window 208 may be attached to either the polishing pad or the platen. As known by those skilled in the art, orbital-type CMP systems have a polishing head and a typically a smaller orbiting platen that rotates during polishing. The molded optical window 208 may be mounted on the polishing pad or the platen.

Figure 2B:
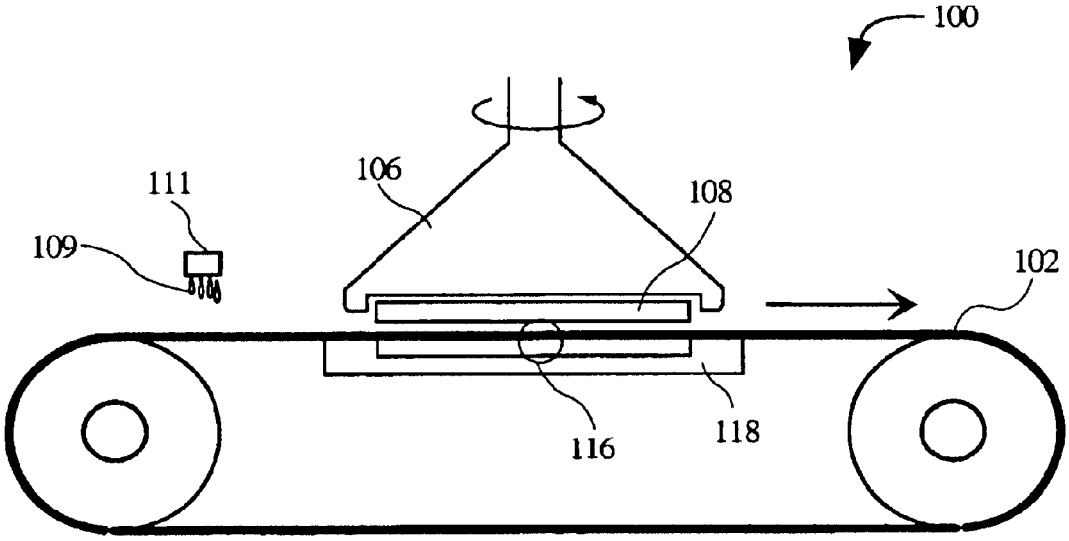
FIG. 2B shows a side view of a CMP system in accordance with one embodiment of the present invention.

FIG. 2B shows a side view of a CMP system 100 in accordance with one embodiment of the present invention. In this embodiment, the wafer 108 is lowered onto the polishing pad 102 by polishing head 106. As this happens, the slurry 109 may be applied to the polishing pad 102 by the slurry dispenser 111 to enhance the polishing of the wafer 108. An optical detection area 116 may include an optical window structure where end point detection may be conducted. Therefore, there may be a hole in the polishing pad 102 and the platen 118 through which optical signals may be transmitted and reflected. By use of the CMP system 100, accurate polishing results may be obtained due to more precise polishing distance readings.

The many embodiments of the molded optical window and the optical window structures described herein may be utilized to planarize any suitable type of wafer such as, for example, 200 mm, 300 mm, etc. It should also be understood that the molded optical window and the optical window structures described herein may be used in any suitable CMP system such as, for example, in a belt-type CMP system as described in reference to FIGS. 2A and 2B, in a rotary-type CMP system, etc.

Figure 3:
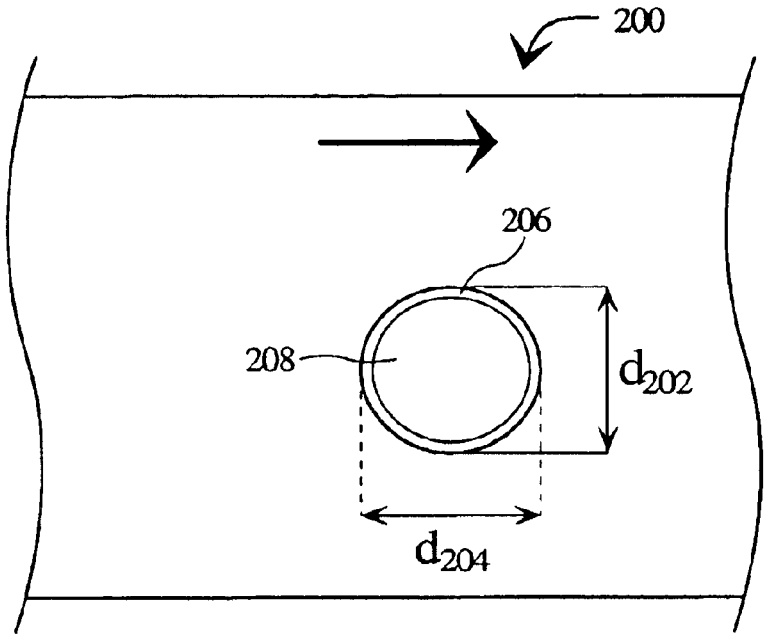
FIG. 3 shows an optical window section of a polishing pad in accordance with one embodiment of the present invention.

FIG. 3 shows an optical window section 200 of a polishing pad in accordance with one embodiment of the present invention. In this embodiment, the optical window section 200 includes an optical window opening 206 with a molded optical window 208. Below the molded optical window 208, an optical detection unit located below a hole or a transparent area in the platen may send optical signals through the hole and through the molded optical window 208 to a wafer and receive optical signals that are reflected back from the wafer through the molded optical window 208. The molded optical window 208 may, in one embodiment, be produced in the manner described in reference to FIGS. 8A through 8D, and FIG. 10 below. In this way, end point detection may be accurately conducted because the configuration of the molded optical window 208 reduces slurry accumulation on a top surface of the molded optical window 208. It should be appreciated that the molded optical window 208 may be any shape or size that would enable optical signals to be sent to the wafer and reflected back from the wafer so an optical detection unit may determine the amount of polishing that has been conducted by CMP such as, for example, an oval, a circle, a rectangle, a square, or any other geometric or amorphous shape.

In one embodiment when a molded optical window is utilized (as discussed below), the optical window opening 206 has a length $d_{202}$ in the axis of polishing pad direction of between about 0.2 inch to about 2.0 inches. A width $d_{204}$ of the optical window opening 206 in the axis perpendicular to the polishing pad direction may be between about 0.1 inch to about 2.0 inches. In a preferable embodiment when the molded optical window is utilized, the length $d_{202}$ can be about 1.0 inch and the width $d_{204}$ may be about 0.6 inch. By use of the molded optical window 208, slurry buildup may be kept to a minimum and optical signal transmission through a molded optical window structure may be kept at an optimal level.

Figure 4:
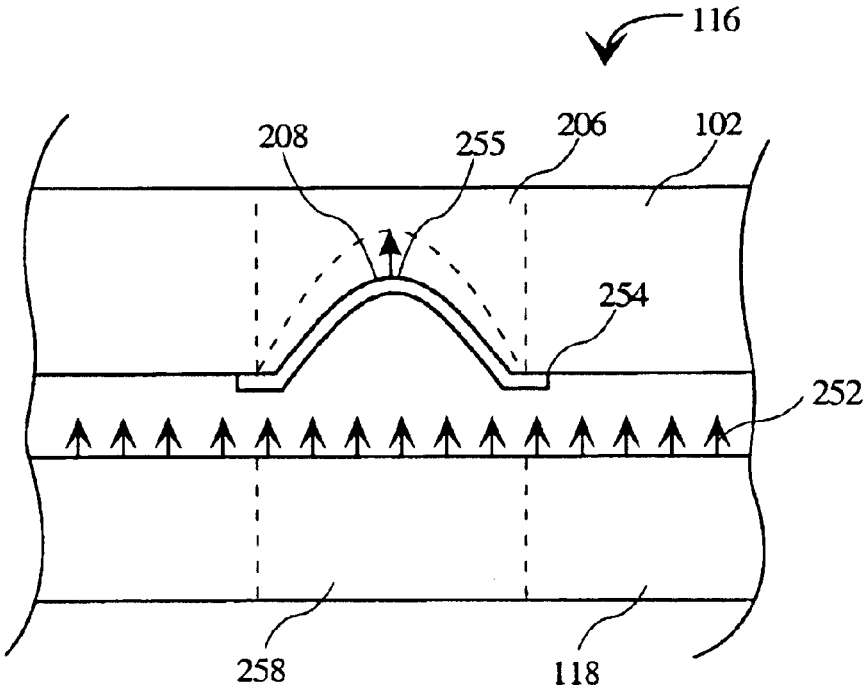
FIG. 4 shows a cut-away side view of an optical detection area in accordance with one embodiment of the present invention.

FIG. 4 shows a cross sectional view of an optical detection area 116 during CMP in accordance with one embodiment of the present invention. In one embodiment, the polishing pad 102 has an optical window opening 206. The optical window opening 206 may contain a molded optical window 208 that moves in a direction 255 to move closer to the wafer 108 during operation when air pressure 252 is applied from the platen 118. Therefore, in this embodiment, the molded optical window 208 can remain partially protruded when the polishing pad 102 is rotating around the rollers. Then when the molded optical window 208 is rolling over the platen 118, an air pressure 252 pushes on the molded optical window 208 so it protrudes further into the optical window opening 206. The molded optical window 208 then takes a configuration as shown by the broken line. It should be understood that the optical window opening 206 may be any suitable dimension that would enable accurate end point detection and proper shaping of the molded optical window 206. Different dimensions that may be utilized regarding the optical window opening 206 is described in detail in reference to FIG. 3.

Slurry that may be preferably applied on the polishing pad can enter the optical window opening 260 and, in prior art systems, block optical signals coming in from a platen opening 258. But, the molded optical window 208 is configured to controllably protrude into an optical window opening 206 and in one embodiment, the optical window 208 may protrude further into the optical window opening when the air pressure 252 is applied. The thickness of the molded optical window 208 may be managed to determine the amount of protrusion into the optical window opening 206 depending on the air pressure from the platen. Once the optical window opening 206 finishes passing over the platen and the air pressure 252 is not applied, the molded optical window 208 becomes reverts back the form before the air pressure 252 was applied. It should be appreciated that the molded optical window 208 may be any type of transparent or semi-transparent material that may be flexible and thin enough to controllably further protrude into the molded optical window with application of the air pressure 252 such as, for example, Mylar-type material, polyester, polyurethane, silicone etc. It should also be understood that the molded optical window 208 may be any suitable dimension that would enable proper end point detection in a CMP process. In one embodiment, the molded optical window 208 is made from a Mylar material enabling optical signal transmission that may be between about 1 mil to about 20 mil in thickness. The thickness may be varied depending on the amount of flexing is desired. In another embodiment, the molded optical window 208 can be about 2 mils in thickness. By use of such a molded optical window, the optical window structure as described herein reduces slurry buildup on a top surface of the molded optical window thereby optimizing optical signal transmission through the molded optical window.

Figure 5:
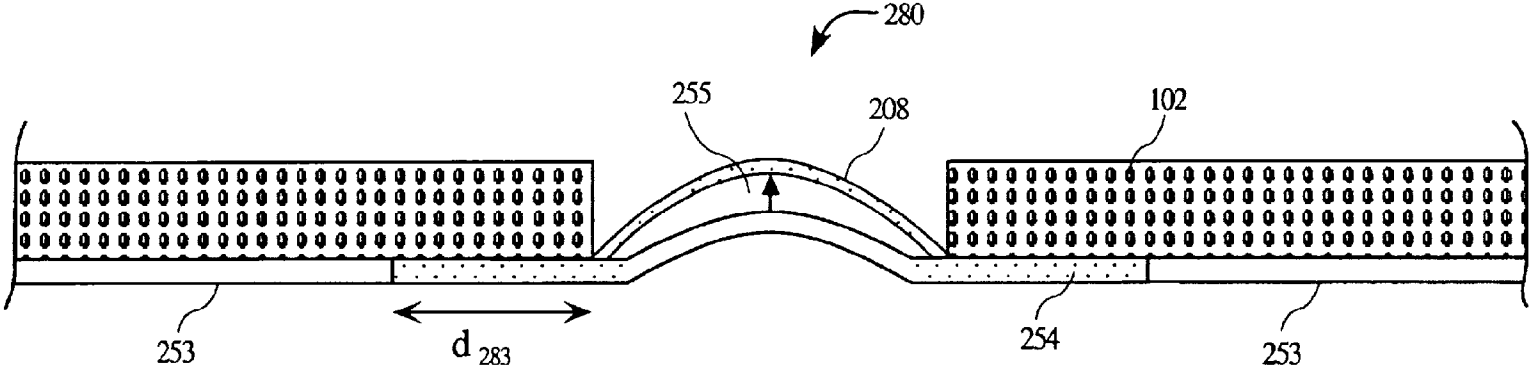
FIG. 5 shows an optical window structure with a molded optical window in accordance with one embodiment of the present invention.

FIG. 5 shows an optical window structure 280 with a molded optical window 208 in accordance with one embodiment of the present invention. In one embodiment, a molded optical window 208 is attached to a polishing pad 102. A backing 253 may optionally be applied to a region of the back portion (side of the polishing pad 102 opposite the side that polishes a substrate) of the polishing pad 102 that the molded optical window 208 is does not cover. The backing 253 may be applied to the polishing pad 102 in any suitable manner such as for example, by adhesive, by pins, etc. In addition, the backing 253 may be any suitable material that can protect the back side of the polishing pad 102 such as, for example, polyethylene, urethane-based material, plastics, rubber, etc. In one embodiment, the backside 253 may be made out of polyethylene. Therefore, in one embodiment, the backing 253 and the molded optical window 253 form a substantially consistent surface along a back side of the polishing pad 102. It should be understood that the molded optical window 208 may be any suitable dimension and may be made out of any suitable type of material. In one embodiment, the molded optical window 208 may protrude into the optical window opening before operation and further protrude into the optical window opening when air pressure is applied to the bottom portion of the molded optical window 208 as during a CMP operation.

In another embodiment, depending on the material utilized, the molded optical window 208 may not protrude further when pressurized air is applied from a platen. It should also be understood that the polishing pad 102 may be made out of any suitable type of material that can effectively polish a wafer such as, for example, polyurethane, cast urethane, and any other type of polymeric material such as, for example a Rodel IC-1000 pad, a Thomas West 813 pad, and the like. In addition, the polishing pad 102 may be any suitable dimension which would enable polishing of the wafer. In one embodiment, the polishing pad 102 is between about 20 mil to about 200 mil in thickness. In another embodiment, the polishing pad 102 is between about 30 mils to about 80 mils in thickness, and in a preferable embodiment, the polishing pad 102 is about 50 mils in thickness. It should also be understood that the molded optical window 208 may be attached to the polishing pad 102 in any suitable way such as, for example, by way of any type of adhesive, pins, etc. The distance $d_{283}$ may be any suitable distance as long as during operation, proper end point detection may be obtained through light (or other types of transmission) through the molded optical window 208. In one embodiment, the molded optical window 208 may be attached to the polishing pad 102 over a distance $d_{283}$ of between 0.2 inch to 2.0 inches. In a preferable embodiment, the distance $d_{283}$ is about 0.5 inch.

When the molded optical window 208 further protrudes up into the optical window opening 206, it moves in a direction 255. Therefore, as the polishing pad 102 is polishing the wafer, slurry that was located on top of the molded optical window 208 falls away thus increasing optical signal intensity through and from the molded optical window 208. It should be appreciated that the molded optical window 208 may protrude up any amount of distance which would permit better slurry draining from the surface of the molded optical window 208 and permit optimal optical signal transmission to and from an optical detection unit (which may be located below the molded optical window 208). In this way, more accurate readings of CMP progress may be made.

Figure 8A:
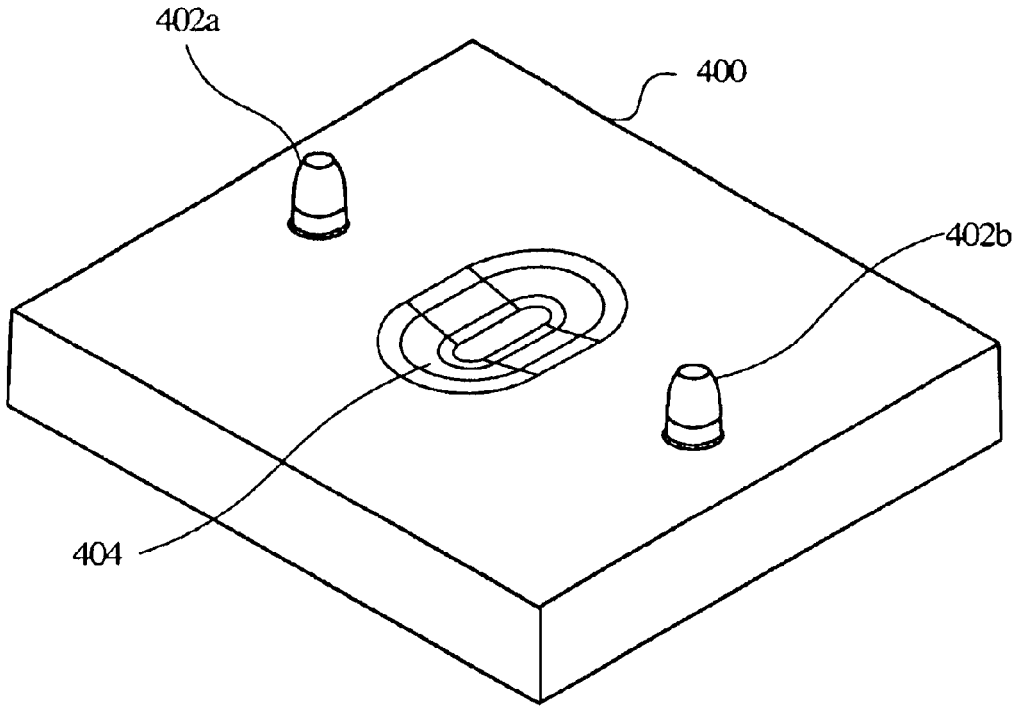
FIG. 8A illustrates a top mold in accordance with one embodiment of the present invention.
Figure 8B:
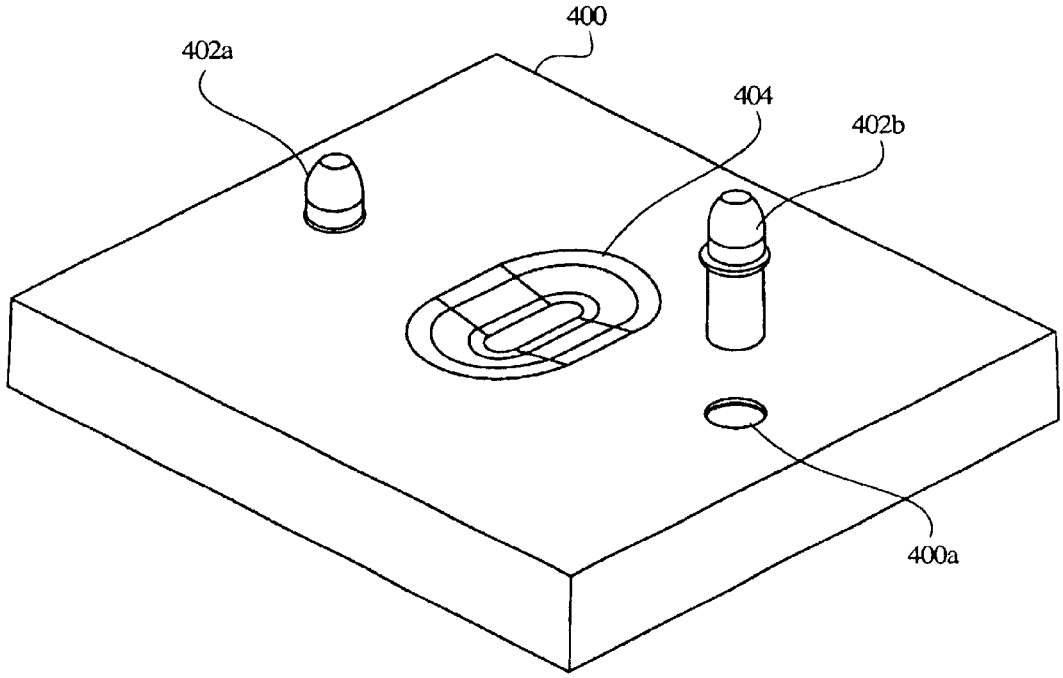
FIG. 8B illustrates a top mold with a removable connecting peg in accordance with one embodiment of the present invention.
Figure 10:
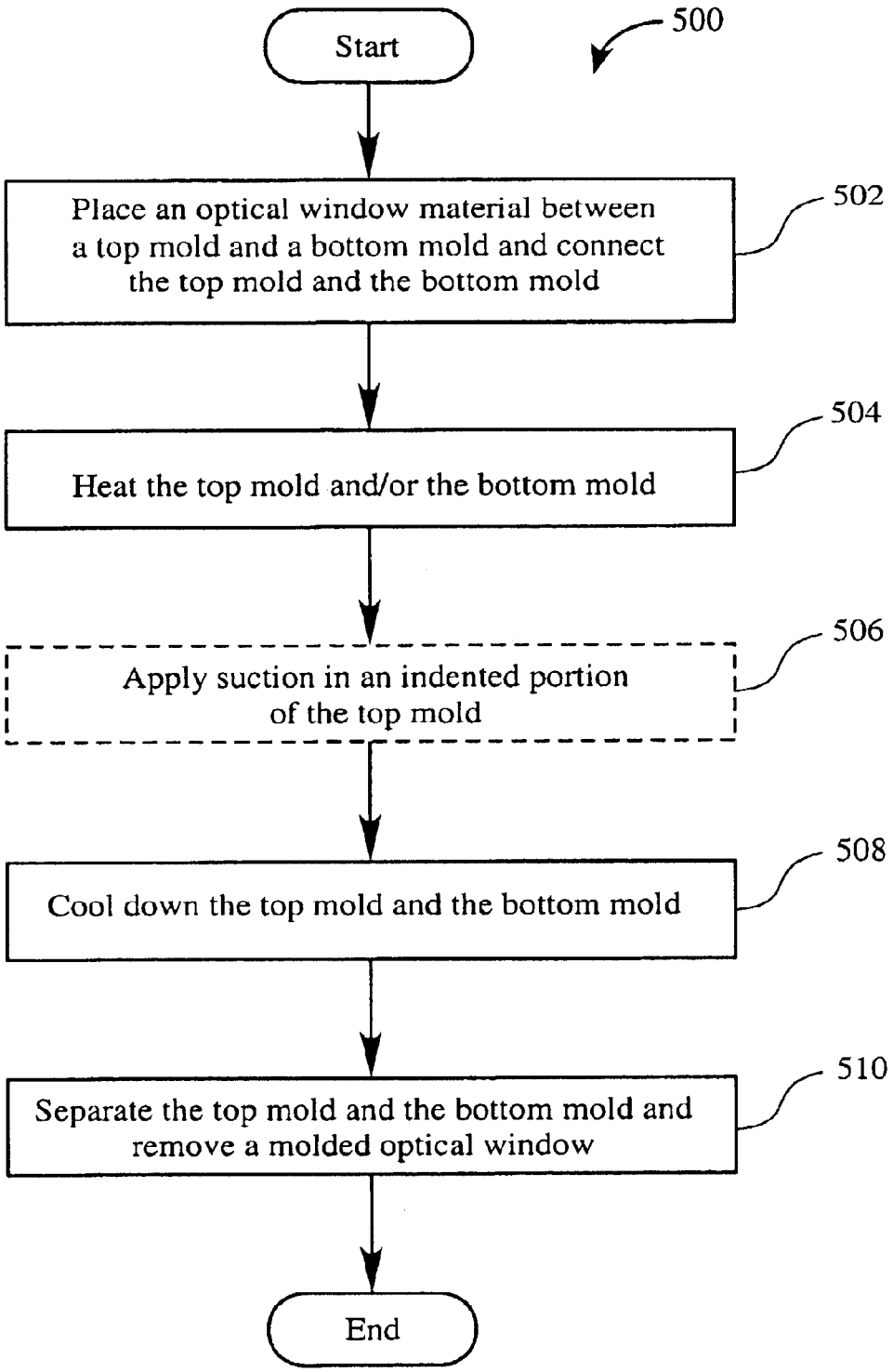
FIG. 10 shows a flowchart which defines an exemplary molding process in accordance with one embodiment of the present invention.

The optical window structure 280 (and 280' below discussed in reference to FIG. 6) may be generated by providing a polishing pad and generating an optical window opening in the polishing pad, molding an optical window as discussed in reference to FIGS. 8A–8B, and 10, and attaching the molded optical window the multi-layer polishing pad so that a molded portion of the optical window at least partially protrudes into the optical window opening. It should be appreciated that this methodology may apply to any suitable pad structure such as one described in reference to FIG. 6.

Figure 6:
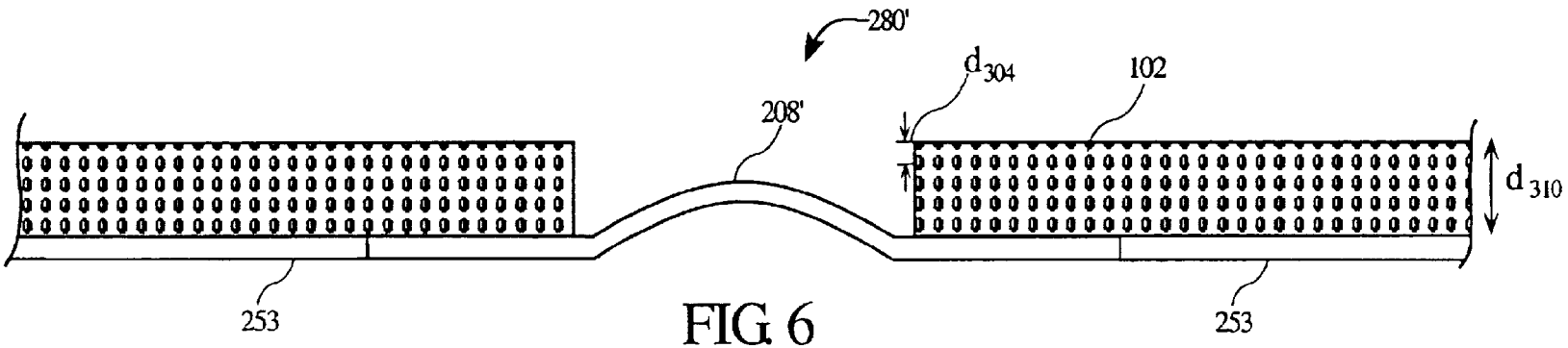
FIG. 6 shows another optical window structure with a molded optical window in accordance with one embodiment of the present invention.

FIG. 6 shows another optical window structure 280' with a molded optical window 208' in accordance with one embodiment of the present invention. In this embodiment, the optical window structure 300 includes the molded optical window 208' that is attached to the polishing pad 102. As with the optical window structure 280 as described in reference to FIG. 5, the polishing pad 102 is shown with optionally backing 253. The polishing pad 102 may be any thickness $d_{310}$ that enables efficient polishing of wafers. In one embodiment, the thickness $d_{310}$ of the polishing pad 102 may be between 0.02 inch to about 0.2 inch. In a preferable embodiment, the thickness $d_{310}$ is about 0.06 to about 0.08 inch. The molded optical window 208' may be attached to the polishing pad 312 in any suitable manner such as, for example, by any type of adhesive, pins, etc.

The molded optical window 208' may be any suitable type of material of any shape, size and construction that would enable optical signal transmission but limit the amount of slurry from accumulating between the molded optical window 208' and a wafer. In one embodiment, the molded optical window 208' may be a transparent, Mylar material. In another embodiment, the molded optical window 208'may be polyester, polyurethane, silicone, etc. It should also be appreciated that a top surface of the molded optical window may be any suitable height that enables protrusion into the optical window opening and enables slurry to be evacuated. In one embodiment, the molded optical window 208' can be recessed below the top surface of the polishing pad 102 as shown by distance $d_{304}$ which may be between about 0.001 inch to about 0.05 inch. In a preferable embodiment, the distance $d_{304}$ can be about 0.01 inch. In one embodiment slurry may be outputted into polishing pad grooves as discussed below in reference to FIG. 13. It should be appreciated that the molded optical window may be any suitable shape when seen from above such as, for example, an oval shape as described in further detail in reference to FIG. 3, circular, rectangular, etc. Therefore, the optical window structure 280' reduces slurry accumulation in an optical window opening and therefore maintains optimal optical signal transmission and reception by an optical detection unit. This enables accurate polishing utilizing advanced end point detection.

The optical window structure 280' may be generated by providing a multi-layer polishing pad and generating an optical window opening in the multi-layer polishing pad, molding an optical window as discussed in reference to FIGS. 8A–8B, and 10, and attaching the molded optical window the multi-layer polishing pad so that a molded portion of the optical window at least partially protrudes into the optical window opening.

Figure 7A:
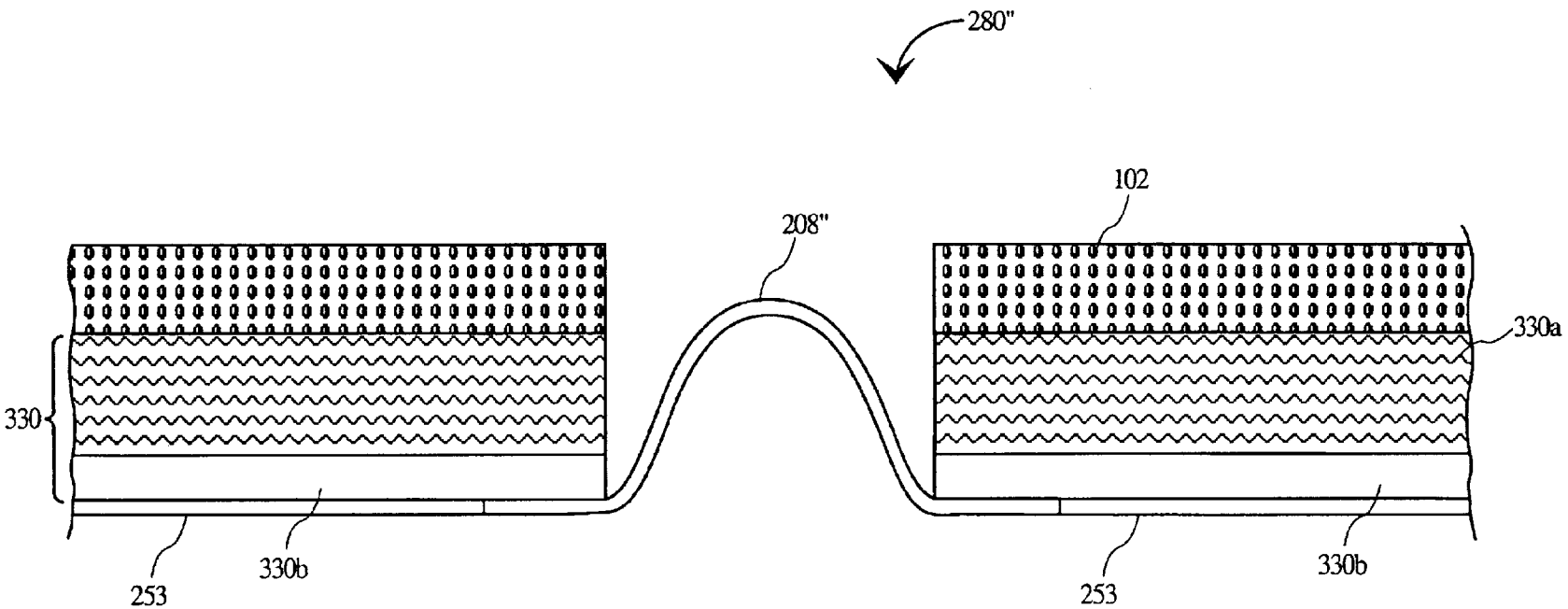
FIG. 7A illustrates a side view of an optical window structure in accordance with one embodiment of the present invention.
Figure 7B:
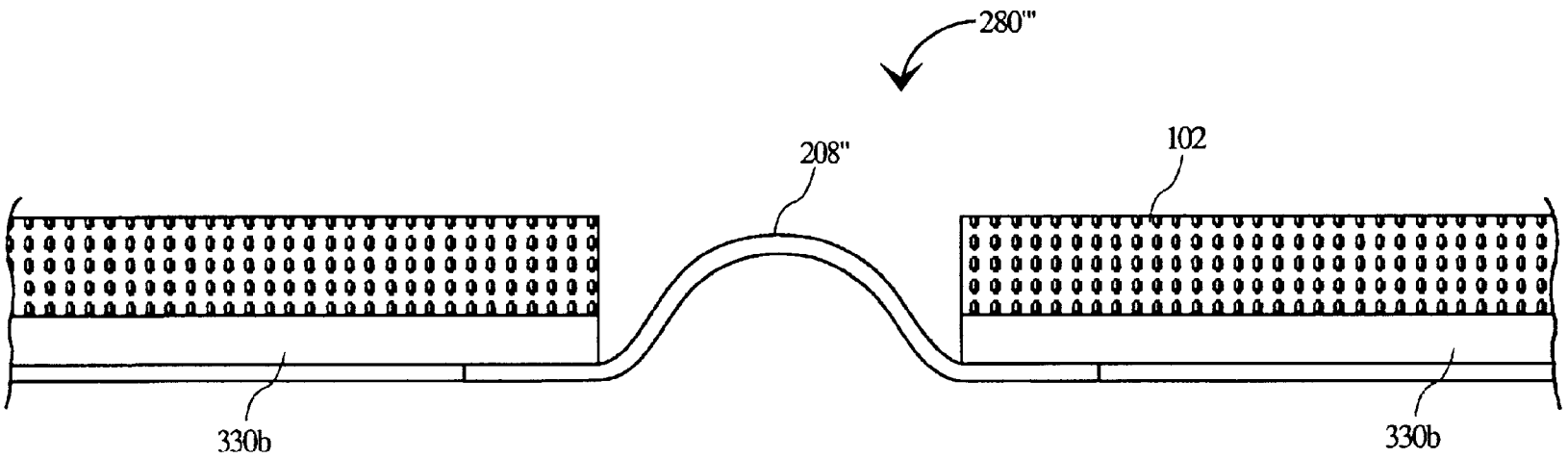
FIG. 7B illustrates an optical window structure with a molded optical window in accordance with one embodiment of the present invention.

It should be appreciated that this methodology may apply to any multi-layer polishing pad structure such as one described in reference to FIG. 7B.

FIG. 7A illustrates a side view of an optical window structure 280" in accordance with one embodiment of the present invention. In this embodiment, the optical window structure 280" includes a polishing pad 102, a support layer 330, and a molded optical window 208. The polishing pad 102 may be any type of pad with any type dimension that would enable accurate and efficient polishing such as, for example, an IC 1000 pad made by Rodel Inc. In one embodiment, the polishing pad 102 may be made up of a polymeric polishing belt and may be between about 0.02 inch and 0.2 inch thick. In another embodiment, the polishing pad 102 may be about 0.032 inch in thickness. In one embodiment, the support layer 330 includes a cushioning layer 330*a* and a reinforcement layer 330*b*. The reinforcement layer may be between about 0.005 inch to about 0.040 inches and is preferably made out of stainless steel although other types of supportive materials may be utilized such as, for example, kevlar, etc. The cushioning layer 330*a* may be made out of any type of material that may provide cushioning to the polishing pad 102 such as, for example, a polyurethane layer made by Thomas West, Inc. The molded optical window 208 may be held in place by an adhesive or by a mechanical connection such as, for example, a pin. When air pressure from an air bearing platen is applied to the bottom portion of the molded optical window 208, the molded optical window 208 may move in a direction 255. In this way, slurry may slide off thus optimizing optical signal transmission and reception in end point detection.

The optical window structure 280" may be generated by providing a multi-layer polishing pad and generating an optical window opening in the multi-layer polishing pad, molding an optical window as discussed in reference to FIGS. 8A–8B, and 10, and attaching the molded optical window the multi-layer polishing pad so that a molded portion of the optical window at least partially protrudes into the optical window opening.

It should be appreciated that this methodology may apply to any multi-layer polishing pad structure such as one described in reference to FIG. 7B.

FIG. 7B illustrates an optical window structure 280'" with a molded optical window 208" in accordance with one embodiment of the present invention. In this embodiment, the optical window structure 280'" includes a polishing pad 102, a support layer 330, and the molded optical window 208". The support layer 330 includes a cushioning layer 330*a* and a reinforcement layer 330*b* which are connected to each other by any type of adhesive. The support layer 330 may also attached to the polishing pad 102 by an adhesive. Examples of adhesives include 3M 442, 3M 467MP, 3M 447, a rubber-based adhesive, etc. A gap between the molded optical window 208" and side wall of the polishing pad 102 may be any distance such as, for example, between about 0.02 inches to about 0.12 inches. In a preferable embodiment, the gap may be about 0.04 inches.

Slurry which would typically accumulate on prior art optical windows can be evacuated off of the molded optical window 208" into a groove or a plurality of grooves of the polishing pad 102. Therefore, a top surface of the molded optical window 208"may stay relatively clear of slurry thus enabling optimal transmission and reception of optical signals by an optical detection unit. Such optimization of optical signal transmission and reception enables better polishing distance measurement resolution thereby increasing accuracy of CMP procedures. This in turn may then increase wafer yield and decrease wafer production costs. In addition, the molded optical window 208 may extend the useful life of the polishing pad 102 and the support layer 330 because if for some reason, the molded optical window fails, then the optical window may be replaced (by re-adhesion) without disposing of the polishing pad 102 and the support layer 330.

FIG. 8A illustrates a top mold 400 in accordance with one embodiment of the present invention. The top mold 400 includes a connecting pegs 402*a* and 402*b* and a molding section 404. The molding section 404 is an indentation in the top mold 400 where a portion of the molded optical window that protrudes into the optical window opening is formed.

FIG. 8B illustrates a top mold 400 with a removable connecting peg 402*b* in accordance with one embodiment of the present invention. The top mold 400*a* shows a removable connecting peg 402*b*. The connecting pegs 402*a* and 402*b* may be utilized to connect with a bottom mold 440 as described in reference to FIGS. 8C and 8D.

Figure 8C:
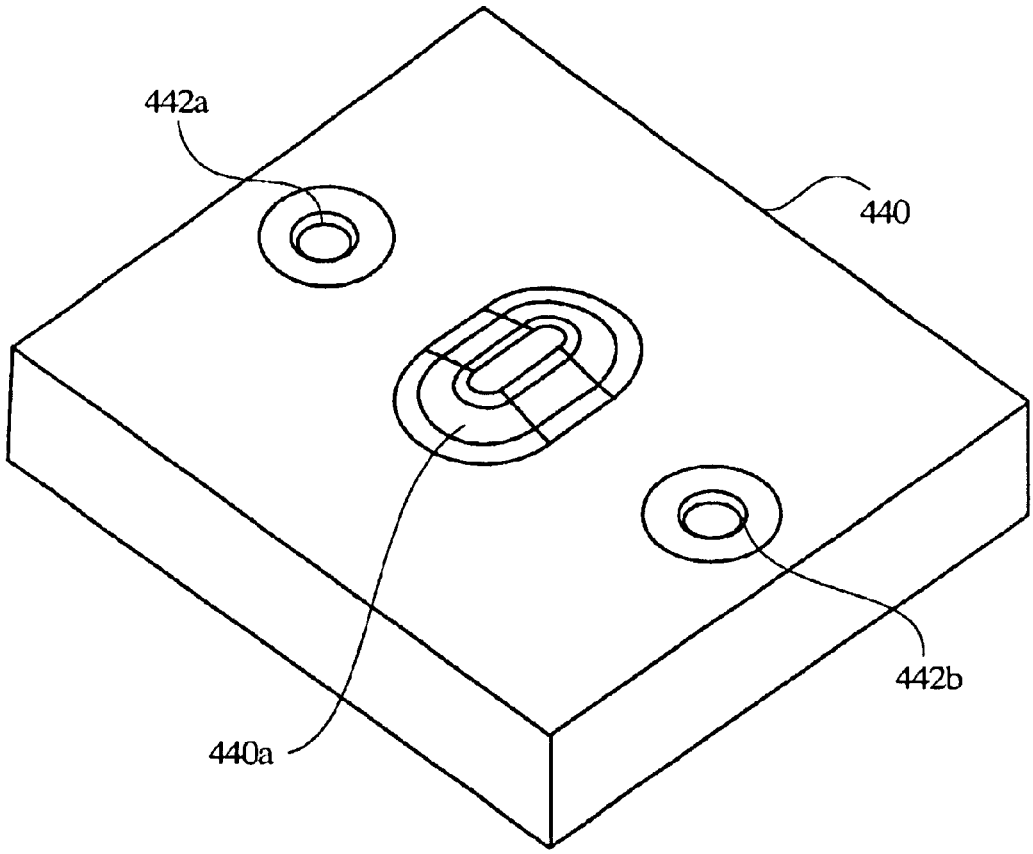
FIG. 8C shows a bottom mold in accordance with one embodiment of the present invention.

FIG. 8C shows a bottom mold 440 in accordance with one embodiment of the present invention. The bottom mold 440 fits together with the top mold 400 to mold a sheet of Mylar like material or any other suitable material such as, for example, polyester, polyurethane, silicon.

Figure 8D:
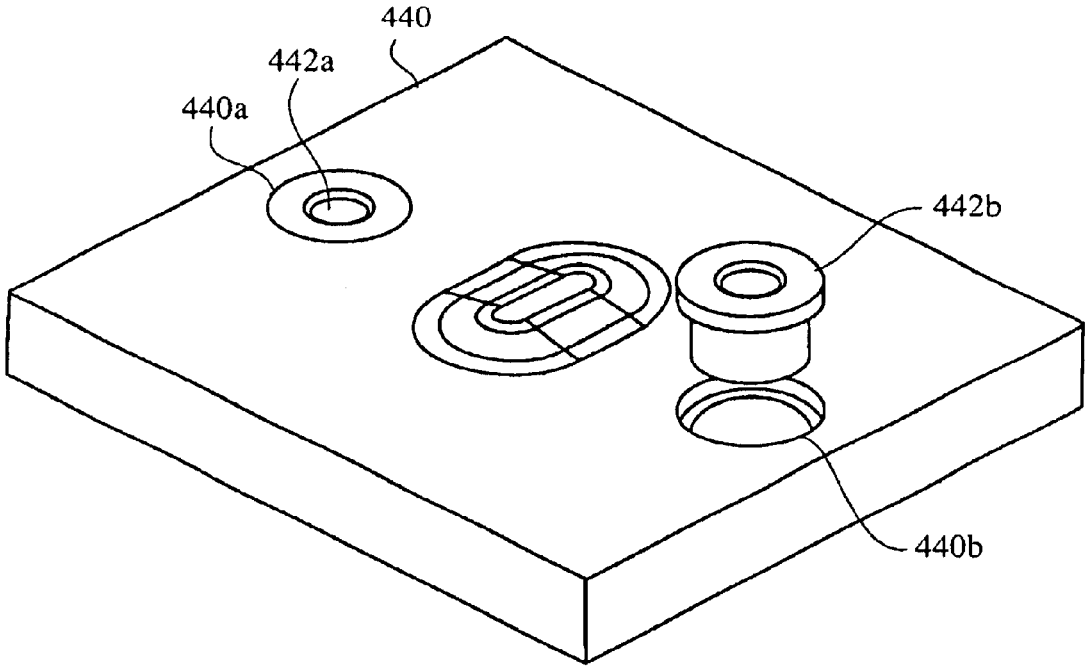
FIG. 8D illustrates a bottom mold with removable connecting holes and in accordance with one embodiment of the present invention.

FIG. 8D illustrates a bottom mold 440 with removable connecting holes 442*a* and 442*b* in accordance with one embodiment of the present invention. The bottom mold 440 shows the removable connecting holes 442*a* and 442*b* that may connect with connecting pegs 402*a* and 402*b* of the top mold 400 as discussed in reference to FIGS. 8A and 8B. It should be appreciated that although the bottom mold 440 has the indentation and the top mold 400 has the protrusion, there may be other embodiments where the top mold 400 has the protrusion and the bottom mold 440 has the indention.

Therefore, in one embodiment, the top mold 400 may be combined with the bottom mold 440 with an optical window film in between the molds 400 and 440. By fitting connecting holes 442*a* and 442*b* of the bottom mold 440 with the connecting pegs 402*a* and 402*b* of the top mold 400, the molds 400 and 440 may be connected so the indentation and the protrusion of the molds 400 and 440 molds the optical window film into the desired molded optical window 208. In this way, the optical window film may be shaped by the molds 10 generate the molded optical window 208. In one embodiment, the molds 400 and 440 may be heated during the molding process. It should be appreciated that the molding process may be adjusted for numerous variables such as, for example, temperature and molding time to enhance the process. In another embodiment, the molds 400 and 440 maybe configured to produce vacuum in the indentation portion to better form the molded optical window 208.

Figure 9A:
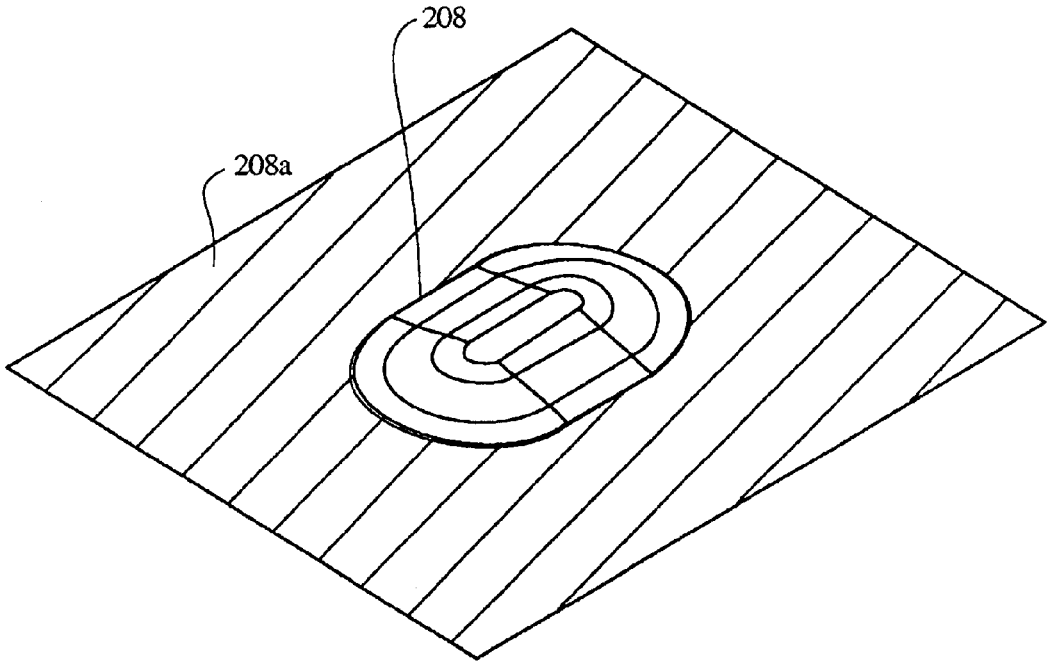
FIG. 9A illustrates a molded optical window in accordance with one embodiment of the present invention.

FIG. 9A illustrates a molded optical window 208 in accordance with one embodiment of the present invention. The molded optical window 208 is a molded portion of a optical window material 208*a* that is flat except for the protruding portion. It should be appreciated that the molded optical window 208 and the optical window material 208*a* that the molded optical window 208 is molded from may be made from any suitable material that can be molded and is at least semi-transparent such as, for example, Mylar-like material, polyester, polyurethane, silicone, etc.

Figure 9B:
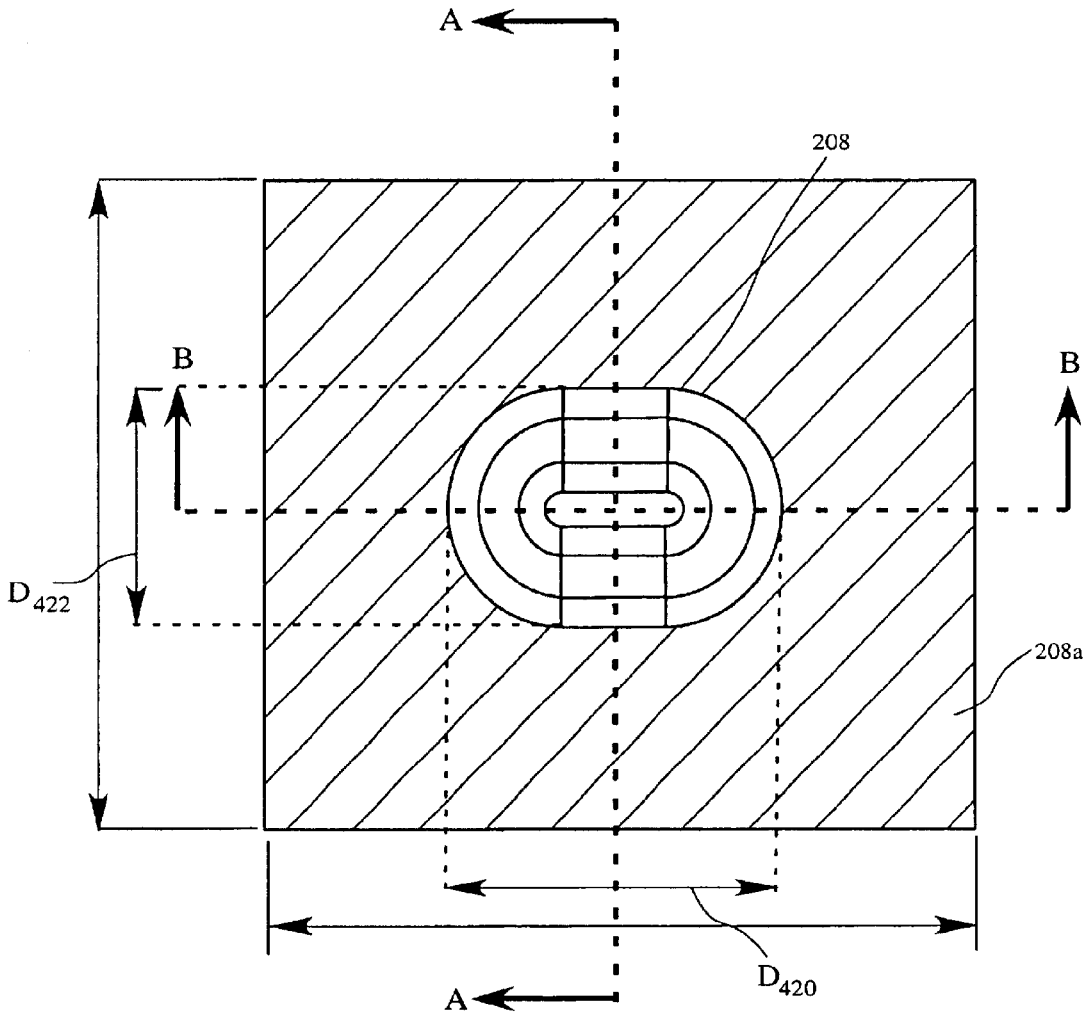
FIG. 9B shows a molded optical window from a top view in accordance with one embodiment of the present invention.

FIG. 9B shows a molded optical window 208 from a top view in accordance with one embodiment of the present invention. It should be appreciated that the molded optical window 208, from the top view, may be any suitable geometrical shape such as, for example, oval, circular, square, rectangular, etc. In one embodiment, the molded optical window 208 is oval shaped where the oval is longer in the direction of the belt direction.

Figure 9C:
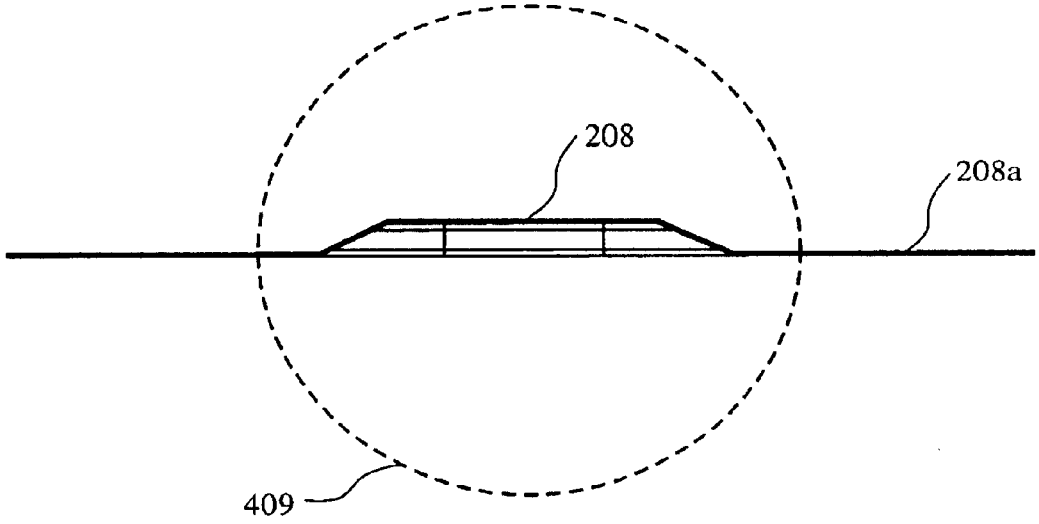
FIG. 9C illustrates a side view of a molded optical window in accordance with one embodiment of the present invention.

FIG. 9C illustrates a side view of a molded optical window 208 in accordance with one embodiment of the present invention. The region 409 encircled by the broken line is a portion of the molded optical window 208 is the region that is discussed in further detail in reference to FIGS. 9D and 9E.

Figure 9D:
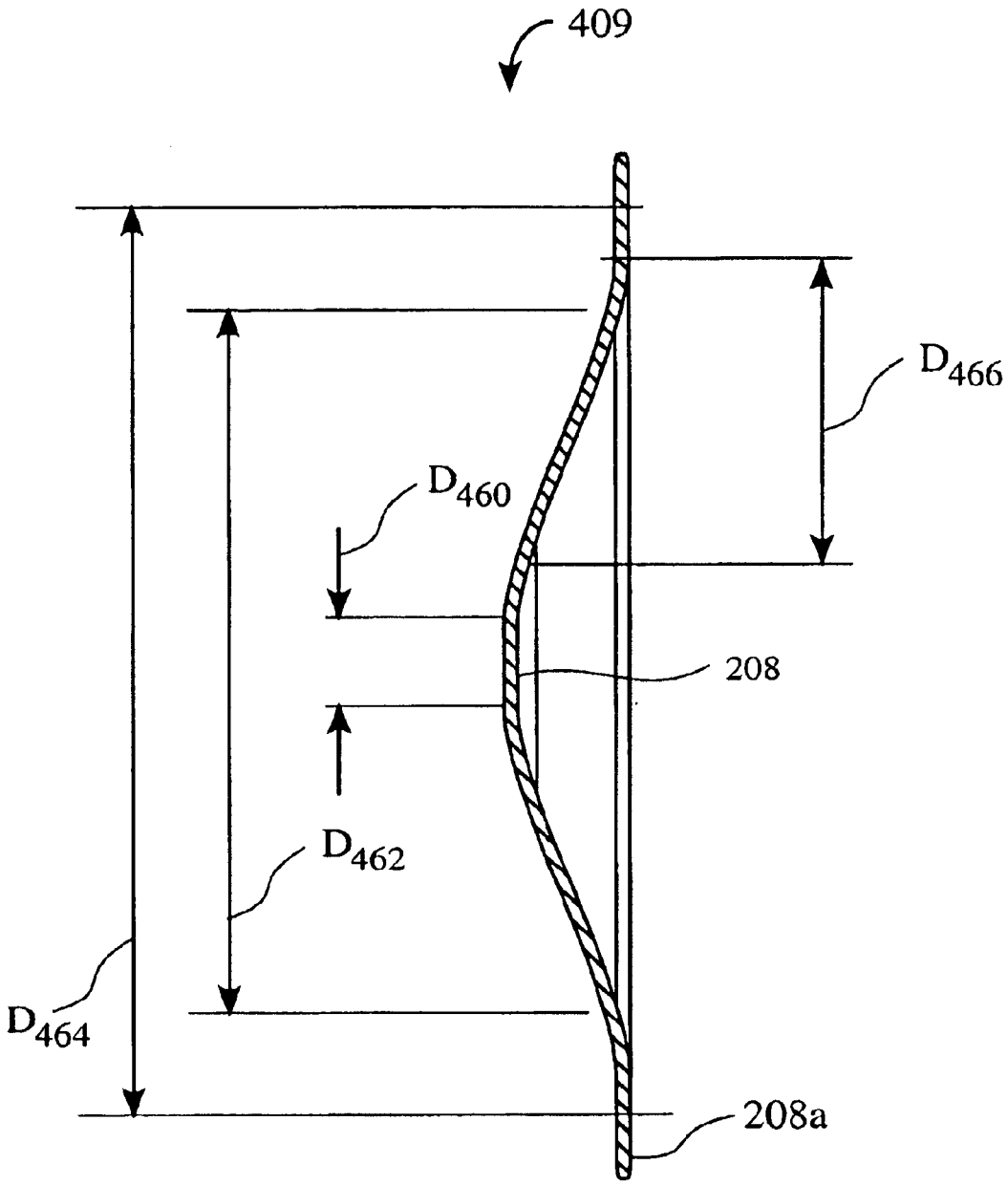
FIG. 9D shows a close up width view of the region molded optical window in accordance with one embodiment of the present invention.

FIG. 9D shows a close up width view of the region 409 molded optical window 208 in accordance with one embodiment of the present invention. FIG. 9D is A—A cross section view of FIG. 9B. The molded optical window 208 may have any suitable type of dimension that may enable slurry removal and optical signals to penetrate the molded optical window 208. The molded optical window 208 has a distance $D_{460}$ that shows a distance of a flat region at a furthermost protrusion region of the molded optical window 208. It should be appreciated that the dimension distances shown herein may be any suitable dimensions as long as the molded optical window can remove slurry during CMP operation and enable end point detection. In one embodiment, the molded optical window has a distance $D_{460}$ of between about 0 inch to about 2 inches. In another embodiment, the distance $D_{460}$ is about 0.13 inch. In one embodiment, the molded optical window 208 has a distance $D_{462}$ of between about 0.01 inch to about 2.0 inches. In another embodiment, the distance $D_{462}$ is about 0.63 inch. In one embodiment, the distance $D_{464}$ is between about 0.2 inch to about 2.0 inches. In one embodiment, $D_{464}$ is about 0.83 inch. In one embodiment, the distance $D_{466}$ is between about 0 inch to about 1 inch. In another embodiment, the distance $D_{466}$ is about 0.25 inch.

Figure 9E:
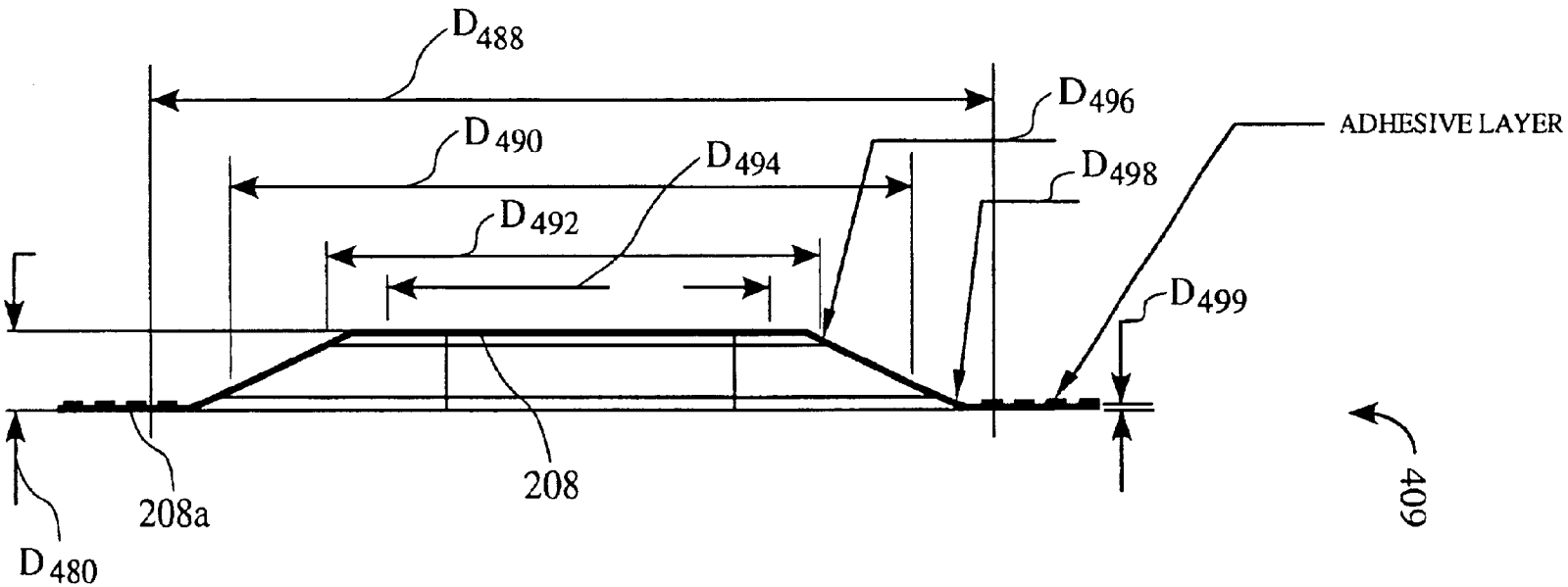
FIG. 9E shows a close up length view of the region of the molded optical window in accordance with one embodiment of the present invention.

FIG. 9E shows a close up length view of the region 409 of the molded optical window 208 in accordance with one embodiment of the present invention. FIG. 9E is B—B cross section view of FIG. 9B. The region 409 shows dimension distances of the molded optical window 208. It should be appreciated that the dimension distances shown herein may be any suitable dimensions as long as the molded optical window can remove slurry during CMP operation and enable end point detection. In one embodiment, the molded optical window has a distance $D_{480}$ of between about 0.001 inch to about 0.5 inch. In another embodiment, the distance $D_{480}$ is about 0.068 inch. In one embodiment, the molded optical window 208 has a distance $D_{488}$ of between about 0.2 inch to about 2.0 inches. In another embodiment, the distance $D_{488}$ is about 1.22 inches. In one embodiment, the distance $D_{490}$ is between about 0.01 inch to about 2.0 inches. In one embodiment, $D_{490}$ is about 1.02 inches. In one embodiment, the distance $D_{492}$ is between about 0 to about 2 inches. In another embodiment, the distance $D_{492}$ is about 0.72 inch. In one embodiment, the distance $D_{494}$ is between about 0 inch to about 2 inches. In another embodiment, the distance $D_{494}$ is about 0.52 inch. In one embodiment, the radius $D_{496}$ is between about 0.1 to about 1.0 inch. In a preferable embodiment, the radius $D_{496}$ is 0.38 inch. In one embodiment, the radius $D_{498}$ is between about 0.1 inch to about 1.0 inch. In a preferable embodiment, the radius $D_{498}$ is about 0.38 inch. The thickness denoted by $D_{499}$ of the molded optical window, which in a preferable embodiment is made out of a Mylar material, is between about 1 mil to about 20 mil with a preferable thickness being 2 mil.

FIG. 10. shows a flowchart 500 which defines an exemplary molding process in accordance with one embodiment of the present invention. Flowchart 500 begins with operation 502 which places an optical window material between a top mold and a bottom mold (as described in reference to FIGS. 8A through 8D) and connects the top mold and the bottom mold. In this way, the optical window material is sandwiched between the two mold sections. Then operation 504 heats the top mold and/or the bottom mold. It should be appreciated that the one or both of the molds may be heated by any suitable manner such as, for example, a heat gun or the mold(s) may be configured to be self heating etc. In addition, the magnitude of heat may be any suitable temperature as long as the optical window material is molded as desired.

After operation 504, the method optionally moves to operation 506 which applies suction (e.g., vacuum) in an indented portion of the mold that has the indentation to better define and form the molded portion of the molded optical window. It should be appreciated that depending on the configuration and the manufacturing process, the top mold may have the indentation or the bottom mold may have the indentation with the complementary molds having a protrusion that fits into the indention. In this operation, the vacuum or suction pulls the portion of the optical window to be molded to the wall of the indentation thereby giving better control of the molding process. In one embodiment, opening(s) may be generated in the indented portion of the mold to generate vacuum in the indented portion. The opening may lead to a passage through the mold to be connectable to an outside suction or vacuum generating apparatus. After either operation 504 or 506 (if the optional operation 506 is conducted), then the method moves to operation 508 where the molded is kept at a heated state for a period of time. Then the method moves to operation 510 where the top mold and the bottom mold are allowed to cool down. Then in operation 512, the top mold and the bottom mold are separated and the molded optical window is removed.

While this invention has been described in terms of several preferred embodiments, it will be appreciated that those skilled in the art upon reading the preceding specifications and studying the drawings will realize various alterations, additions, permutations and equivalents thereof. It is therefore intended that the present invention includes all such alterations, additions, permutations, and equivalents as fall within the true spirit and scope of the invention.

What is claimed is:

1. An optical window structure for use in chemical mechanical planarization, comprising:

a polishing pad;

an optical window opening in the polishing pad; and a molded optical window attached to an underside of the polishing pad, a molded portion of the optical window at least partially protruding into the optical window opening in the polishing pad.

2. An optical window structure for use in chemical mechanical planarization as recited in claim 1, further comprising:

a backing attached to a bottom surface of the polishing pad.

3. An optical window structure for use in chemical mechanical planarization as recited in claim 1, wherein the backing is made out of one of a polyethylene urethane-based material, plastics, and rubber.

4. An optical window structure for use in chemical mechanical planarization as recited in claim 1, wherein the molded optical window is made out of one of a Mylar-type material, polyurethane, polyester, and silicone.

5. An optical window structure for use in chemical mechanical planarization as recited in claim 1, wherein the molded optical window is one of an oval, a circle, a rectangle, and a square.

6. An optical window structure for use in chemical mechanical planarization as recited in claim 1, wherein the molded optical window is attached to the polishing pad by an adhesive.

7. An optical window structure for use in chemical mechanical planarization as recited in claim 1, wherein a thickness of the molded optical window is between about 1 mil and about 20 mil.

8. An optical window structure for use in chemical mechanical planarization as recited in claim 7, wherein the thickness of the molded optical window corresponds to a level of protrusion of the optical window into the optical window opening during operation.

9. An optical window structure for use in chemical mechanical planarization as recited in claim 1, wherein the molded optical window is used in one of a belt-type CMP system, a rotary-type CMP system, and an orbital-type CMP system.

10. An optical window structure for use in chemical mechanical planarization as recited in claim 1, wherein the molded portion of the optical window is configured to further protrude into the optical window during a CMP operation.

11. An optical window structure for use in chemical mechanical planarization as recited in claim 1, wherein the optical window structure is utilized for planarization of one of shallow trench isolation, inter-level dielectric (ILD)/inter-metal dielectric (IMD), tungsten, and poly-silicon.

12. A method to generate an optical window structure, comprising:

providing a polishing pad;

generating an optical window opening in the polishing pad;

molding an optical window; and attaching the molded optical window to an underside of the polishing pad so that a molded portion of the optical window at least partially into the optical window opening.

13. A method to generate an optical window structure as recited in claim 12, further comprising:

providing a backing layer, the backing layer; and attaching the backing layer to a portion of the underside of the polishing pad not attached to the optical window.

14. A method to generate an optical window structure as recited in claim 12, wherein the attaching the molded optical window includes applying an adhesive to the underside of the polishing pad and applying the optical window to the underside of the polishing pad.

15. A method to generate an optical window structure as recited in claim 12, wherein the molding includes, providing an optical window material;

placing the optical window material between a top mold and a bottom mold;

connecting the top mold to the bottom mold;

heating the top mold and the bottom mold; and separating the top mold and the bottom mold.

16. A method to generate an optical window structure as recited in claim 15, wherein the molding further includes, applying vacuum in an indented portion of one of the top mold and the bottom mold.

17. An optical window structure for use in chemical mechanical planarization, comprising:

a polishing pad;

an optical window opening in the polishing pad; and a optical window attached to an underside of the polishing pad, the optical window being molded so a molded portion of the optical window at least partially protrudes into the optical window opening in the polishing pad.

18. An optical window structure for use in chemical mechanical planarization, comprising:

a multi-layer polishing pad;

an optical window opening in the multi-layer polishing pad; and an optical window having a molded portion, the optical window being attached to an underside of the multi-layer polishing pad, the molded portion of the optical window at least partially protruding into the optical window opening.

19. An optical window structure for use in chemical mechanical planarization as recited in claim 18, further comprising:

a backing attached to a bottom surface of the multi-layer polishing pad.

20. An optical window structure for use in chemical mechanical planarization as recited in claim 19, wherein the backing is made out of one of a polyethylene urethane-based material, plastics, and rubber.

21. An optical window structure for use in chemical mechanical planarization as recited in claim 18, wherein the optical window is made out of one of a Mylar-type material, polyurethane, polyester, and silicone.

22. An optical window structure for use in chemical mechanical planarization as recited in claim 18, wherein the optical window is used in one of a belt-type CMP system, a rotary-type CMP system, and an orbital-type CMP system.

23. An optical window structure for use in chemical mechanical planarization as recited in claim 18, wherein the molded portion of the optical window is configured to further protrude into the optical window during a CMP operation.

24. An optical window structure for use in chemical mechanical planarization as recited in claim 18, wherein the optical window structure is utilized for planarization of one of shallow trench isolation, inter-level dielectric (ILD)/inter-metal dielectric (IMD), tungsten, and poly-silicon.

25. An optical window structure for use in chemical mechanical planarization as recited in claim 18, wherein the multi-layer polishing pad includes, a polishing pad; and a support layer.

26. An optical window structure for use in chemical mechanical planarization as recited in claim 25, wherein the support layer includes one of a stainless steel belt and a Kevlar-type belt.

27. An optical window structure for use in chemical mechanical planarization as recited in claim 25, wherein the support layer includes, a cushioning layer; and a reinforcement layer.

28. A method to generate an optical window structure, comprising:

providing a multi-layer polishing pad;

generating an optical window opening in the multi-layer polishing pad;

molding an optical window; and attaching the molded optical window the multi-layer polishing pad so that a molded portion of the optical window at least partially protrudes into the optical window opening.

29. A method to generate an optical window structure as recited in claim 28, further comprising:

providing a backing layer; and attaching the backing layer to a portion of the underside of the polishing pad not attached to the optical window.

30. A method to generate an optical window structure as recited in claim 28, wherein the attaching the molded optical window includes applying an adhesive to the underside of the multi-layer polishing pad and applying the optical window to the underside of the polishing pad.

31. A method to generate an optical window structure as recited in claim 28, wherein the molding includes, providing an optical window material;

placing the optical window material between a top mold and a bottom mold;

connecting the top mold to the bottom mold;

heating the top mold and the bottom mold; and separating the top mold and the bottom mold.

32. A method to generate an optical window structure as recited in claim 31, wherein the molding further includes, applying vacuum in an indented portion of one of the top mold and the bottom mold.

* * * * *